US012397962B2

(12) United States Patent
Bressan et al.

(10) Patent No.: US 12,397,962 B2
(45) Date of Patent: Aug. 26, 2025

(54) CHILD-PROOF PACKAGE, PROCESS OF MAKING THE SAME AND METHOD OF OPENING THE SAME

(71) Applicant: I.G.B. S.R.L., Milan (IT)

(72) Inventors: Alessio Bressan, Varese (IT); Michel Bressan, Induno Olona (IT); Alberto Gandolla, Induno Olona (IT)

(73) Assignee: I.G.B. S.R.L., Milan (IT)

( * ) Notice: Subject to any disclaimer, the term of this patent is extended or adjusted under 35 U.S.C. 154(b) by 0 days.

(21) Appl. No.: 17/639,891

(22) PCT Filed: Aug. 28, 2020

(86) PCT No.: PCT/IB2020/058038
§ 371 (c)(1),
(2) Date: Mar. 2, 2022

(87) PCT Pub. No.: WO2021/044266
PCT Pub. Date: Mar. 11, 2021

(65) Prior Publication Data

US 2022/0332460 A1 Oct. 20, 2022

(30) Foreign Application Priority Data

Sep. 2, 2019 (IT) ..... 102019000015354

(51) Int. Cl.
*B65D 5/68* (2006.01)
*B65D 5/38* (2006.01)
*B65D 5/66* (2006.01)

(52) U.S. Cl.
CPC ..... *B65D 5/685* (2013.01); *B65D 5/38* (2013.01); *B65D 5/665* (2013.01); *B65D 2215/02* (2013.01)

(58) Field of Classification Search
CPC ..... B65D 5/685
See application file for complete search history.

(56) References Cited

U.S. PATENT DOCUMENTS 1,130,271 A 3/1915 Hammond
1,253,489 A 1/1918 Houghland
(Continued)

FOREIGN PATENT DOCUMENTS

CA 471536 A 2/1951
CA 2026295 A1 * 6/1991 ..... B65D 5/248
(Continued)

OTHER PUBLICATIONS

Third Party Observations cited in European Application No. 20771616.8 mailed May 12, 2022, 14 pages.
(Continued)

*Primary Examiner* — Mollie Impink
(74) *Attorney, Agent, or Firm* — Nixon & Vanderhye P.C.

(57) ABSTRACT

A child proof package including a container and a case configured for receiving the container; case and container are movable between a closed condition and an open condition. The package includes a safety device having: a first coupling portion carried by the case, a second coupling portion carried by the container; the first and the second coupling portion, in the closed condition of the case, are configured for engaging with each other to define a locking condition of the safety device in which the first and second coupling portion prevent case and container from passing from the closed condition to the open condition. The safety device includes a release portion configured for allowing the disengagement of the first and second coupling portion.

14 Claims, 12 Drawing Sheets

(56) References Cited

U.S. PATENT DOCUMENTS

| | | | | | |
|---|---|---|---|---|---|
| 2,351,825 | A * | 6/1944 | Limbert | B65D 5/685 229/117.17 |
| 2,559,320 | A | 7/1951 | Rushing et al. | |
| 2,579,346 | A | 12/1951 | Theander | |
| 2,652,969 | A * | 9/1953 | Pfaff | B65D 5/3642 229/117.07 |
| 2,711,282 | A | 6/1955 | D'Esposito | |
| 2,777,630 | A | 1/1957 | Moberger | |
| 2,939,624 | A | 6/1960 | Wilson | |
| 3,093,291 | A | 6/1963 | Brandle | |
| 3,116,007 | A | 12/1963 | D'Esposito et al. | |
| 3,568,827 | A | 3/1971 | Haring | |
| 3,692,231 | A * | 9/1972 | Neitzke | B65D 5/685 206/815 |
| 3,860,111 | A | 1/1975 | Thompson | |
| 3,942,712 | A * | 3/1976 | Bundy | B65D 5/5425 229/149 |
| 4,053,100 | A * | 10/1977 | Baptist | B65D 5/685 229/125.26 |
| 4,127,230 | A | 11/1978 | Bamburg et al. | |
| 5,040,722 | A | 8/1991 | Fromion et al. | |
| 5,148,973 | A * | 9/1992 | Zimmermann | B65D 5/685 229/125.26 |
| 6,296,175 | B1 * | 10/2001 | Dixon | B65D 5/685 229/102 |
| 6,394,275 | B1 | 5/2002 | Paliotta et al. | |
| 6,491,211 | B1 | 12/2002 | Evans et al. | |
| 10,442,565 | B2 * | 10/2019 | Mulvey | B65D 5/38 |
| 2005/0173291 | A1 | 8/2005 | Specker et al. | |
| 2008/0283434 | A1 | 11/2008 | Gelardi | |
| 2012/0234701 | A1 | 9/2012 | Albrecht et al. | |
| 2014/0262839 | A1 | 9/2014 | Le et al. | |
| 2014/0346220 | A1 | 11/2014 | Saulas | |
| 2017/0297803 | A1 | 10/2017 | Chambers et al. | |
| 2020/0039707 | A1 | 2/2020 | Kachian et al. | |

FOREIGN PATENT DOCUMENTS

| | | | |
|---|---|---|---|
| CA | 2162087 | A1 | 5/1997 |
| CH | 710519 | | 6/2016 |
| CN | 204642380 | | 9/2015 |
| DE | 92 14 914 | | 2/1993 |
| EP | 0 443 930 | | 8/1991 |
| EP | 0 454 506 | | 10/1991 |
| EP | 0 571 711 | | 12/1993 |
| EP | 1 743 842 | | 1/2007 |
| EP | 2 808 265 | | 12/2014 |
| EP | 3 090 955 | | 11/2016 |
| EP | 3 216 712 | | 9/2017 |
| EP | 3587293 | A1 | 1/2020 |
| FR | 897384 | A * | 3/1945 |
| FR | 2 609 689 | | 7/1988 |
| FR | 2 646 830 | | 11/1990 |
| JP | 2000-118528 | A | 4/2000 |
| WO | 00/51897 | A1 | 9/2000 |
| WO | 2004/052749 | | 6/2004 |
| WO | 2005/068304 | | 7/2005 |
| WO | 2009/038219 | | 3/2009 |
| WO | 2012/112538 | | 8/2012 |
| WO | 2013014462 | | 1/2013 |
| WO | 2015/170203 | | 11/2015 |
| WO | 2016/198978 | | 12/2016 |
| WO | 2017/216662 | | 12/2017 |

OTHER PUBLICATIONS

U.S. Appl. No. 17/639,488, Office Action, Jun. 22, 2023, 21 pages.
U.S. Appl. No. 17/639,782, Office Action, May 18, 2023, 26 pages.
Notice of Opposition cited in European Patent No. 3997002 mailed Oct. 4, 2023, 53 pages.
European Search Report cited in Application No. 23188213.5 mailed Nov. 13, 2023, 11 pages.
Notice of Opposition cited in Application No. 20771616.8 mailed Oct. 16, 2023, 58 pages.
Letter from the Opponent cited in Application No. 20771616.8 mailed Jul. 22, 2024, 92 pages.

* cited by examiner

FIG.2
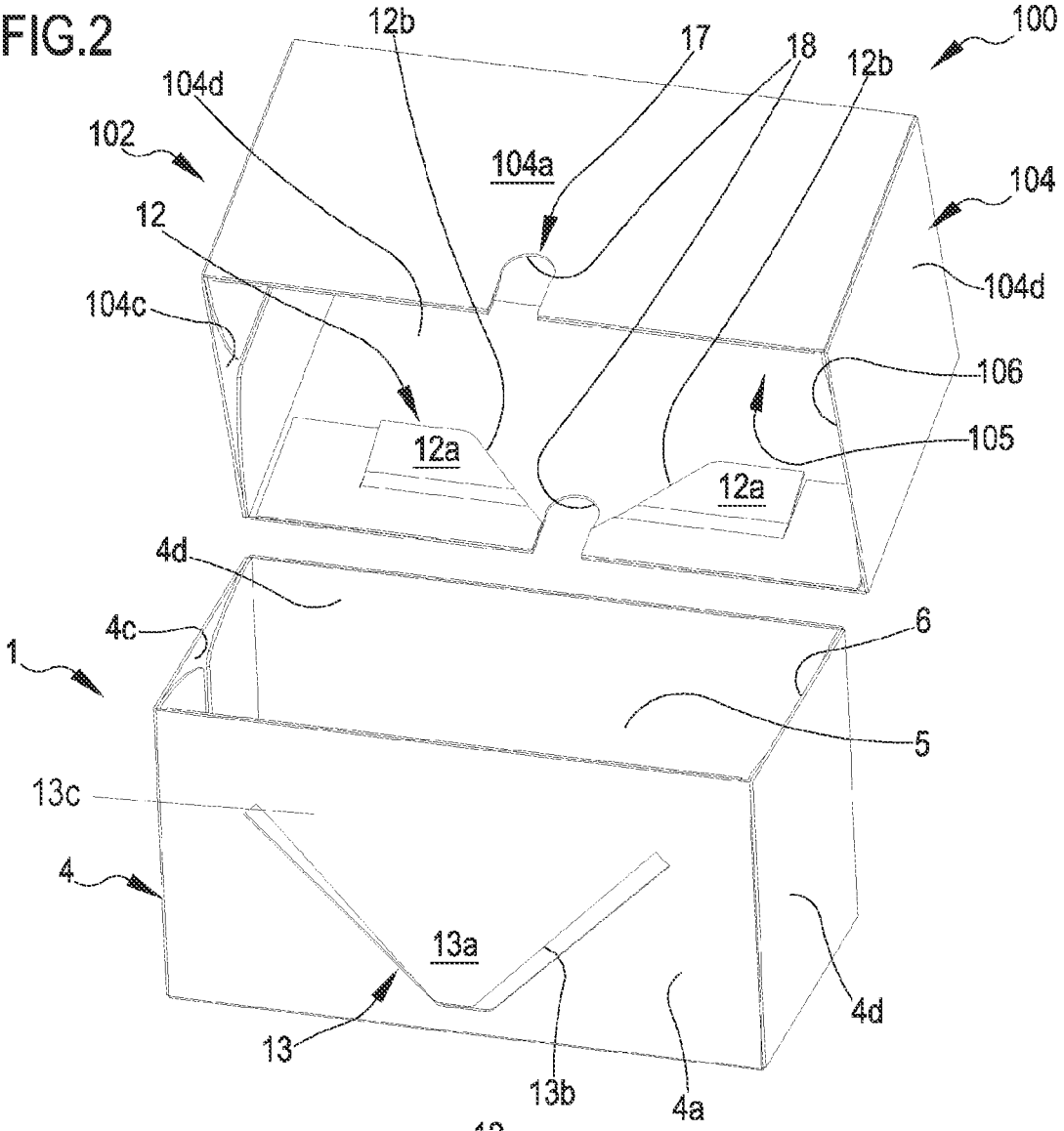
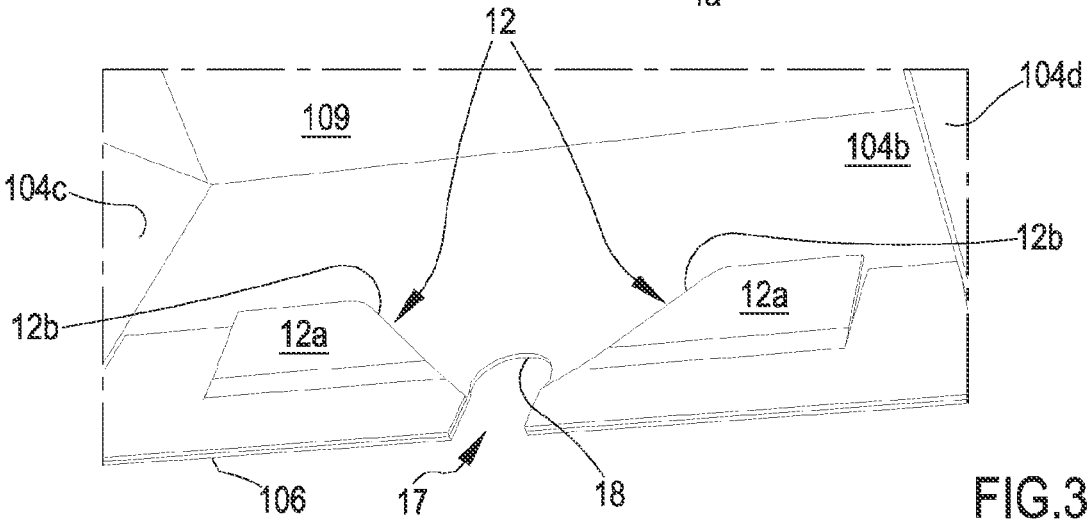
FIG.3

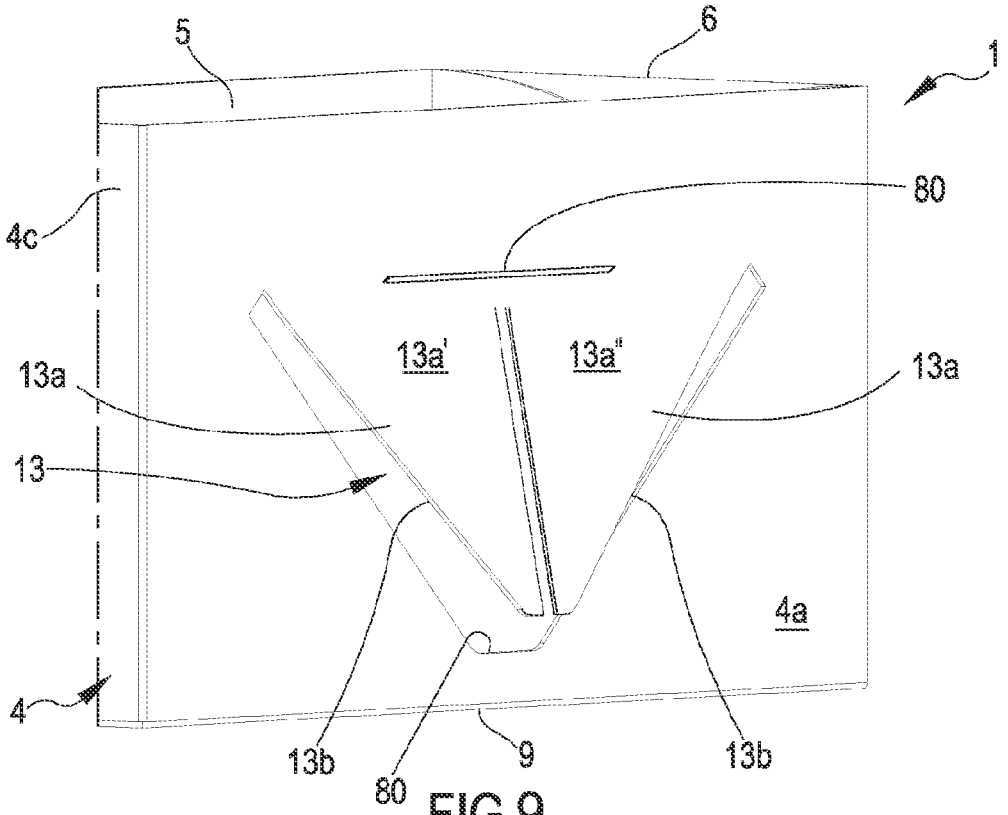
FIG.9
FIG.10
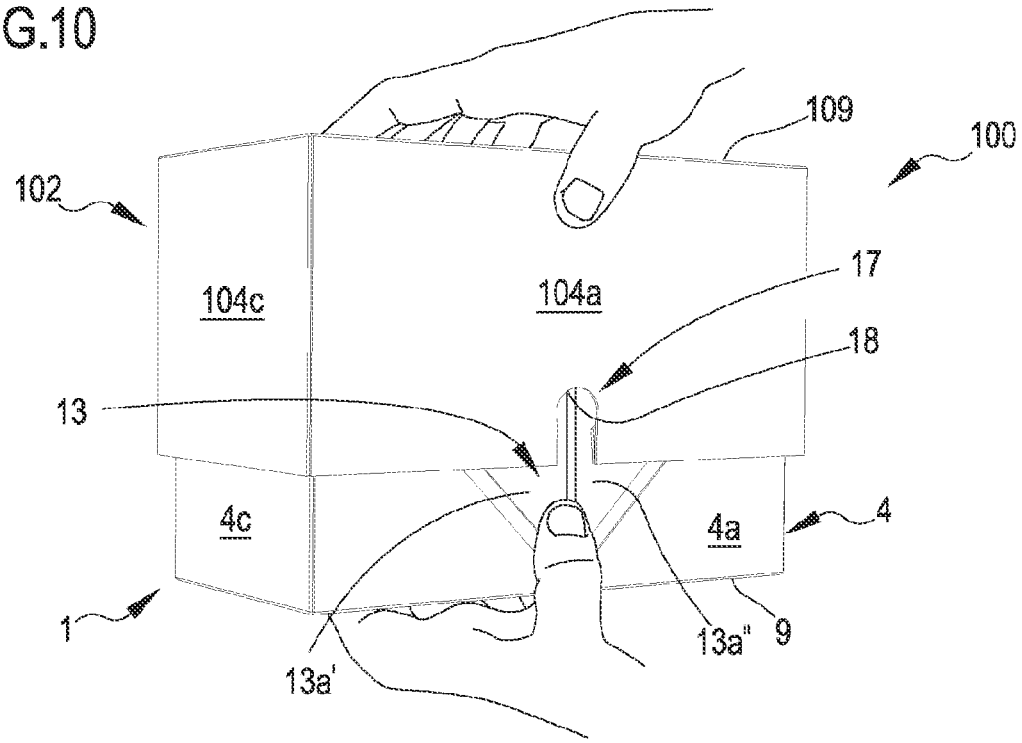

CHILD-PROOF PACKAGE, PROCESS OF MAKING THE SAME AND METHOD OF OPENING THE SAME

This application is the U.S. national phase of International Application PCT/IB2020/058038, filed Aug. 28, 2020, which designated the U.S. and claims priority to Italian patent application IT 102019000015354, filed Sep. 2, 2019, the entire contents of each of which are hereby incorporated by reference.

FIELD OF THE FINDING

The object of the present invention is a child-proof package and a process of making the same, as well as a method for closing and opening the package. The package may find application in the field of packaging for products of various kind, such as: drugs, cosmetics, cleaning products (detergents for linens/sheets and dishes), foods and tobacco-based products (cigars and cigarettes).

STATE OF THE ART

Child-proof packages are known that are specially designed in order to be difficult for most children under 5 years old to open; these package types are employed for preventing young children from coming into contact with products that are potentially dangerous for them.

One known child-proof package comprises a paper case adapted to receive a plastic material blister at its own interior that is intended to contain a plurality of products. The case has, at opposite longitudinal lateral walls, two slits intended to receive in engagement two projections of the blister: in the condition in which the blister is housed in the case, the engagement of the projections with the slits prevents the extraction of the blister by means of only a pulling action of the same. For the extraction of the blister from the case, it is necessary to press on the projections so as to cause the disengagement thereof from the slits; only at this point it is possible to extract the blister from the case. The Applicant has detected that these packages are not free of limitations and drawbacks. Indeed, the above-described packages define a closure by means of the cooperation between case and blister; this characteristic renders the packages poorly flexible in their use: in order to be able to define a child-proof safety system, the case can only receive a blister specially designed and made for that particular case. The blisters must therefore be attained by means of specific production methods, preventing the manufacturing thereof by means of standard production machines. It is also indicated that the blisters of the described packages have a rather complex structure due to the presence of the protuberances, which negatively affects the production and product costs.

A further known child-proof package is described in the patent application No. WO 2017/216662 A1. The package comprises a case adapted to receive a casing for housing products at its own interior. The case is in the form of a hollow container and internally has an engagement portion which is configured for engaging with an abutment element brought by the container in order to allow the locking of the container itself within the case and consequently preventing the picking up of products. The disengagement between the case and the container occurs following the insertion of an opening device within the package.

A further known package is described in the patent application No. U.S. Pat. No. 3,116,007 A. Such package comprises a container with tray form configured for defining a compartment for containing products and having a single top opening, delimited by a free edge, through which it is possible to deposit/pick up the products. The package also comprises a cover configured for being placed outside the container in closing the top opening. The container comprises two tabs folded outside the compartment starting from the free edge and which are configured for engaging with two respective undercuts defined within the cover. The cover comprises two through accesses configured for allowing a user, during a closed condition of the package, to disengage the tabs from the undercuts of the cover in order to allow the opening of said package. Packages similar to that described in the application No. U.S. Pat. No. 3,116,007 A are described in the following patent documents: U.S. Pat. Nos. 4,053,100 A; 1,130,271 A; and 2,579,346 A.

A further known package is described in the patent application No. U.S. Pat. No. 2,777,630 A. Such package comprises a container with tray form configured for defining a compartment for containing products and having a single top opening through which it is possible to deposit/pick up the products. The package also comprises a cover configured for being placed outside the container in closing the top opening. On the lateral wall of the container, a through notch is present that is adapted to define a passage for the insertion and engagement of a locking tab carried by the cover: the locking tab is defined on an external lateral wall of the cover and is configured for being folded from the outside and inserted in the compartment of the container through the notch. Such package is openable following the deformation of the container at the notch: the deformation of the container allows the extraction of the tab from the notch and the consequent disengagement of the cover from the container.

The Applicant has noted as the above-described known solutions have several limitations and therefore they can be improved with regard to several aspects.

OBJECT OF THE FINDING

Object of the present invention is therefore that of substantially resolving at least one of the drawbacks and/or limitations of the preceding solutions.

One objective of the present invention is that of providing a package that is flexible in its use, having a safety system that is strong and highly effective, capable of preventing the opening of the package by children, but which simultaneously can be easily openable by an adult. Another objective of the present invention is to provide a package having a structure which is hard for children to handle and thus capable of preventing the correct grip for the opening of the same. Another object of the present invention is to provide a package having a simple structure, which can be manufactured in a quick and inexpensive manner. Another object of the present invention is to provide a package having a stable structure that is able to ensure its own integrity following multiple openings and closings of the same. These objects and still others, which will be clearer from the following description, are substantially achieved by a package, a process of making the package and a method for closing and opening the same in accordance with that expressed in one or more of the enclosed claims and/or of the following aspects.

SUMMARY

In one aspect, a child-proof package (100) is provided, comprising:

at least one container (1) defining a compartment (3) for housing at least one product, said container (1) having a predetermined number of lateral walls (4) defining an opening (5) delimited by a free edge (6), said opening (5) being configured for allowing the insertion and the picking up of the product from the container (1), at least one case (102) having a predetermined number of lateral walls (104) defining at least one access (105) delimited by a free edge (106) configured for allowing the passage of the container (1), said predetermined number of lateral walls (104) of the case (102) delimiting an internal volume (103) configured for receiving in insertion at least part of the container (1), wherein the case (102) and the container (1) are relatively movable with respect to each other at least between:

a closed condition in which the case (102) obstructs the opening (5) of the container (1), wherein the container (1), in said closed condition, is at least partly arranged in the internal volume (103) of the case (102), an open condition in which the case (102) allows the communication between the compartment (3) and the external environment, at least one safety device (11) comprising:

at least one first coupling portion (12) carried by the case (102), at least one second coupling portion (13) carried by the container (1), wherein the first and the second coupling portion (12, 13), in the closed condition, are configured for being stably engaged with each other to define a locking condition of the safety device (11) in which said first and second coupling portion (12, 13) prevent the case (102) from passing from the closed condition to the open condition, wherein the safety device (11) comprises a release portion (17) configured for allowing, at least in the locking condition of the safety device (11), intervention from outside the package on at least one between said first and second coupling portion (12, 13) in order to allow the disengagement thereof and thus allow the passage of case (102) and container (1) from the closed condition to the open condition.

In a further aspect in accordance with the preceding aspect the first coupling portion (12) is substantially arranged within the case (102). In a further aspect in accordance with any one of the preceding aspects the first coupling portion is at least partly arranged in the internal volume (103).

In a further aspect in accordance with any one of the preceding aspects the second coupling portion (13) is arranged outside the compartment (3).

In a further aspect in accordance with any one of the preceding aspects the container is made of sheet material, optionally paper. In a further aspect in accordance with any one of the preceding aspects the case (102) is made of sheet material, optionally paper.

In a further aspect in accordance with any one of the preceding aspects the first coupling portion (12) is entirely arranged in the internal volume (103) of the case. In a further aspect in accordance with any one of the preceding aspects the first coupling portion (12) is distanced from the free edge (106) of the case (102). In a further aspect in accordance with any one of the preceding aspects the second coupling portion (13) is distanced from the free edge (6) of the container (1).

In a further aspect in accordance with any one of the preceding aspects the first and the second coupling portion (12, 13), in the locking condition, are engaged outside the compartment (3) of the container (1).

In a further aspect in accordance with any one of the preceding aspects the first and the second coupling portion (12, 13), in the locking condition, are engaged inside the internal volume (103) of the case (102). In a further aspect in accordance with any one of the preceding aspects the container (1), in the open condition, is completely separated from the case (102).

In a further aspect in accordance with any one of the preceding aspects the release portion is configured for defining at least one through access (18) on the case (102). In a further aspect in accordance with any one of the preceding aspects the release portion (17), in the locking condition, is arranged at the first and second coupling portion (12, 13).

In a further aspect in accordance with any one of the preceding aspects the release portion (17) is configured for allowing a user, at least in the locking condition of the safety device (11), to intervene from outside the package on at least one of said first and second coupling portion (12, 13) manually and/or by means of an opening device, optionally insertable through the through access (18).

In a further aspect in accordance with any one of the preceding aspects the release portion (17) comprises at least one through access (18) defined on at least one lateral wall (104) of the case (102) and which allows the communication between external environment and the internal volume (103). In a further aspect in accordance with any one of the preceding aspects the release portion (17), optionally the through access (18), is configured for allowing, at least in the locking condition of the safety device (11), intervention from outside the package (100) directly on the second coupling portion (13).

In a further aspect in accordance with any one of the preceding aspects the first coupling portion (12) comprises at least one tab (12*a*) engaged with at least one lateral wall (104) of the case (102). In a further aspect in accordance with any one of the preceding aspects, the tab (12*a*) of the first coupling portion (12) is arranged substantially in the internal volume (103). In a further aspect in accordance with any one of the preceding aspects, the tab (12*a*) of the first coupling portion is extended from a lateral wall of the case (optionally defining an external wall of the case) according to a direction entering said internal volume (103).

In a further aspect in accordance with any one of the preceding aspects the tab (12*a*) defines an undercut delimited by at least one gripping edge (12*b*), optionally placed entirely in the internal volume (103), distinct and distanced from the free edge (106) of the access (105). In a further aspect in accordance with any one of the preceding aspects the tab (12*a*) of the first coupling portion (12) has a substantially trapezoidal shape. In a further aspect in accordance with any one of the preceding aspects at least one section of the gripping edge (12*b*) of the tab (12*a*) of the first coupling portion (12) is tilted with respect to the free edge (106) of the access (105), optionally by an angle comprised between 20° and 80°, still more optionally by an angle comprised between 30° and 70°.

In a further aspect in accordance with any one of the preceding aspects the first coupling portion (12) is integrally joined with at least one lateral wall (104) of the case (102). In a further aspect in accordance with any one of the preceding aspects the first coupling portion (12) is integrally joined with at least one lateral wall (104) of the case (102) by means of a folding edge to define a folded portion. In a further aspect in accordance with any one of the preceding aspects, the folding edge between first coupling portion (12) and the lateral wall, with which said portion is integrally joined, defines at least one part of the free edge (106) of the access (105) of the case (102). In a further aspect in accordance with any one of the preceding aspects the first coupling portion (12), optionally the tab (12*a*), faces a lateral wall of the case (102). In a further aspect in accordance with any one of the preceding aspects the first coupling portion (12), optionally the tab (12*a*), is extended along a plane substantially parallel to a lying plane of the lateral wall of the case with which said first coupling portion is directly carried (optionally integrally joined).

In a further aspect in accordance with any one of the preceding aspects the first coupling portion (12) comprises two tabs (12*a*) distanced and flanked each other. In a further aspect in accordance with any one of the preceding aspects the release portion (17), optionally the through access (18), is defined in interposition between the two tabs of the first coupling portion (12). In a further aspect in accordance with any one of the preceding aspects the two tabs (12*a*) of the first coupling portion (12) are positioned symmetrically with respect to the release portion (17). In a further aspect in accordance with any one of the preceding aspects the two tabs define two gripping edges (12*b*) distanced from each other and entirely positioned in the internal volume (103), distanced from the free edge (106) of the access (105). In a further aspect in accordance with any one of the preceding aspects the gripping edges (12*b*) of the two tabs of the first coupling portion (12) define a substantially V-shaped form whose concavity is directed on the opposite side with respect to the access (105).

In a further aspect in accordance with any one of the preceding aspects the safety device (11) comprises at least two first coupling portions (12) engaged with at least one lateral wall (104) of the case (102). In a further aspect in accordance with any one of the preceding aspects the two first coupling portions (12) are engaged with respective lateral walls (104) of the case (102) that are opposite each other.

In a further aspect in accordance with any one of the preceding aspects the predetermined number of lateral walls (104) of the case (102) comprises:

- a front wall (104*a*),
- a rear wall (104*b*) opposite the front wall (104*b*),
- a first lateral wall (104*c*) which connects the front and rear wall (104*a*, 104*b*),
- a second lateral wall (104*d*) opposite the first lateral wall and which also connects the front and rear wall (104*a*, 104*b*).

In a further aspect in accordance with any one of the preceding aspects the first coupling portion (12) is engaged at least with the front wall (104*a*) of the case (102). In a further aspect in accordance with any one of the preceding aspects the safety device (11) comprises two first coupling portions (12) respectively carried by the front and rear wall (104*a*, 104*b*) of the case (102).

In a further aspect in accordance with any one of the preceding aspects the case (102) comprises a top wall (109) configured for being abutted, in the closed condition, against the free edge (6) of the opening (5) of the container in order to obstruct the latter.

In a further aspect in accordance with any one of the preceding aspects the predetermined number of lateral walls (104) of the case (102) emerges from a perimeter edge of the top wall (109). In a further aspect in accordance with any one of the preceding aspects the gripping edge (12*b*) of each first coupling portion (12) is arranged in interposition between the top wall (109) and the access (105) of the case (102).

In a further aspect in accordance with any one of the preceding aspects the through access (18) of the release portion (17) has an open perimeter profile. In a further aspect in accordance with any one of the preceding aspects the through access (18) of the release portion (17) is integrally joined to the free edge (106) of the access (105) of the case (102) and essentially defines a groove of said free edge (106).

In a further aspect in accordance with any one of the preceding aspects the through access (18) of the release portion (17) has a closed perimeter profile. In a further aspect in accordance with any one of the preceding aspects the through access (18) of the release portion (17) is distanced from the free edge (106) of the access (105) of the case (102). In a further aspect in accordance with any one of the preceding aspects the through access (18) of the release portion (17) is interposed between said free edge (106) of the access (105) and the top wall of the same case (102).

In a further aspect in accordance with any one of the preceding aspects the second coupling portion (13) comprises at least one panel (13*a*) carried by at least one lateral wall (4) of the container (1). In a further aspect in accordance with any one of the preceding aspects the panel (13*a*) of the second coupling portion (13) substantially emerges from a lying plane of the lateral wall (4) of the container directly carrying said panel (13*a*), according to a direction exiting from the compartment (3). In a further aspect in accordance with any one of the preceding aspects the panel (13*a*) of the second coupling portion (13) defines an undercut delimited by at least one gripping edge (13*b*) placed externally with respect to the compartment (3). In a further aspect in accordance with any one of the preceding aspects the gripping edge (13*b*) of the panel (13*a*) is distinct and distanced from the free edge (6) of the opening (5) of the container itself.

In a further aspect in accordance with any one of the preceding aspects the undercut defined by the panel (13*a*) of the second coupling portion (13), in the closed condition, is stably engaged with the undercut of the tab (12*a*) of the first coupling portion (12) to define said locking condition.

In a further aspect in accordance with any one of the preceding aspects at least one section of the gripping edge (13*b*) of the panel (13*a*) has a substantially triangular shape or substantially trapezoidal shape or V-shaped or C-shaped form. In a further aspect in accordance with any one of the preceding aspects at least one section of the gripping edge (13*b*) of the panel (13*a*) is tilted with respect to the free edge (6) of the opening (5). In a further aspect in accordance with any one of the preceding aspects at least in section of the gripping edge (13*b*) of the panel (13*a*) is tilted with respect to the free edge (6) of the same container by an angle comprised between 20° and 80°, still more optionally by an angle comprised between 30° and 70°. In a further aspect in accordance with any one of the preceding aspects the panel (13*a*) of the second coupling portion (13) is extended substantially along a surface which is tilted with respect to a lying plane of the lateral wall (4) of the container (1) directly carrying said panel, optionally by an angle comprised between 1° and 30°, still more optionally by an angle comprised between 1° and 20°. In a further aspect in accordance with any one of the preceding aspects the tilt angle of the panel (13*a*) is measured between facing surfaces of the panel (13*a*) and of the lateral wall of the container directly carrying (optionally integrally joined) said panel (13*a*).

In a further aspect in accordance with any one of the preceding aspects the panel (13*a*), in the locking condition, is interposed between the at least one tab (12*a*) of the first coupling portion (12) and the lateral wall (104) of the case directly carrying said at least one tab. In a further aspect in accordance with any one of the preceding aspects the panel (13*a*), in the locking condition, is interposed between the two tabs (12*a*) flanked the first coupling portion (12). In a further aspect in accordance with any one of the preceding aspects the second coupling portion (13) is integrally joined with at least one lateral wall (4) of the container (1).

In a further aspect in accordance with any one of the preceding aspects the panel (13*a*) of the second coupling portion is joined, by means of a folding edge, with a lateral wall (4) of the container (1) to define a folded portion, the panel (13*a*) facing and at least partly superimposed on the lateral wall (4) with which it is directly integrally joined. In a further aspect in accordance with any one of the preceding aspects the panel (13*a*) is integrally joined to the lateral wall of the container (4) essentially defining, in cooperation with the latter, a single external lateral wall of the container. In a further aspect in accordance with any one of the preceding aspects the panel (13*a*) is made on a lateral wall (4) of the container by means of a through cut of said lateral wall, optionally the panel (13*a*) defining at least part of the lateral wall (4) of the container with which the same panel is integrally joined. In a further aspect in accordance with any one of the preceding aspects the panel (13*a*) projects from the lateral wall (4) with which it is integrally joined according to a direction exiting from the compartment (3).

In a further aspect in accordance with any one of the preceding aspects the second coupling portion (13), optionally the panel (13*a*) of the second coupling portion (13), is interposed—in the locking condition—between the release portion (17) and the first coupling portion (12).

In a further aspect in accordance with any one of the preceding aspects the safety device (11) comprises at least two second coupling portions (13) engaged with at least one lateral wall (4) of the container (1). In a further aspect in accordance with any one of the preceding aspects the safety device (11) comprises a second coupling portion (13) for each first coupling portion (12) present on the case (102). In a further aspect in accordance with any one of the preceding aspects the two second coupling portions (13) are engaged with respective lateral walls (4) of the container (1) that are opposite each other. In a further aspect in accordance with any one of the preceding aspects the predetermined number of lateral walls (4) of the container (1) comprises:

- a front wall (4*a*),
- a rear wall (4*b*) opposite said front wall (4*b*) of the container,
- a first lateral wall (4*c*) which connects the front and rear wall (4*a*, 4*b*) of the container,
- a second lateral wall (4*d*) opposite the first lateral wall of the container and which also connects the front and rear wall (4*a*, 4*b*) of the container.

In a further aspect in accordance with any one of the preceding aspects wherein, in the closed condition:

- the front walls (4*a*, 104*a*) respectively of the container and of the case are directly facing each other,
- the rear walls (4*b*, 104*b*) respectively of the container and of the case are directly facing each other,
- the first lateral walls (4*c*, 104*c*) respectively of the container and of the case are directly facing each other,
- the second lateral walls (4*b*, 104*d*) respectively of the container and of the case are directly facing each other.

In a further aspect in accordance with any one of the preceding aspects the predetermined number of lateral walls of the case is at least partly counter-shaped with respect to the predetermined number of lateral walls of the container. In a further aspect in accordance with any one of the preceding aspects the second coupling portion (13) is engaged at least with the front wall (4*a*) of the container (1). In a further aspect in accordance with any one of the preceding aspects the safety device (11) comprises two second coupling portions (13) respectively carried by the front and rear wall (4*a*, 4*b*) of the container (1).

In a further aspect in accordance with any one of the preceding aspects the container (1) comprises a bottom wall (9), the predetermined number of lateral walls (4) of the container (1) emerging from a perimeter edge from the bottom wall (9). In a further aspect in accordance with any one of the preceding aspects the bottom wall (9), in the closed condition, is opposite the top wall (109) of the case (102). In a further aspect in accordance with any one of the preceding aspects the at least one second coupling portion (13) of the container (1) is defined in interposition between the bottom wall (9) and the opening (5) of the container (1). In a further aspect in accordance with any one of the preceding aspects the at least one second coupling portion (13) of the container (1) is defined in interposition between the bottom wall (9) and the free edge (6) of the container (1). In a further aspect in accordance with any one of the preceding aspects the at least one second coupling portion (13), optionally the panel (13*a*), is distinct and distanced from the free edge (6) of the opening (5) of the container (1). In a further aspect in accordance with any one of the preceding aspects the at least one coupling portion (13), optionally the panel (13*a*), is placed at a minimum distance (D in FIG. 16) along a longitudinal direction from the free edge (6) of the container (1) equal to or greater than 5 mm, optionally equal to or greater than 7 mm, still more optionally comprised between 7 mm and 30 mm. In a further aspect in accordance with any one of the preceding aspects the panel (13*a*) of the second coupling portion (13) is extended starting from an attachment portion (13*c*) along a longitudinal direction in moving away from the free edge (6) of the container (1). In a further aspect in accordance with any one of the preceding aspects the attachment portion (13*c*) of the panel (13*a*) is integrally joined with the lateral wall (4) of the container (1) directly carrying said panel (13*a*). In a further aspect in accordance with any one of the preceding aspects the attachment portion (13*c*) of the panel (13*a*) is distanced from the free edge (6) of the container (1).

In a further aspect in accordance with any one of the preceding aspects the panel (13*a*) of the second coupling portion (13) is extended length-wise starting from a lateral wall (4) of the container (1) directly carrying said panel (optionally starting from the attachment portion 13*c*) along a predetermined longitudinal direction, wherein said panel (13*a*) has a predetermined length equal to or greater than 15 mm, optionally comprised between 15 mm and 100 mm; in which the predetermined length of the panel is measured along said predetermined longitudinal direction.

In a further aspect in accordance with any one of the preceding aspects the panel (13*a*) of the second coupling portion (13) is extended length-wise starting from a lateral wall (4) of the container (1) along a predetermined longitudinal direction, wherein the ratio between the distance present between the panel (13*a*) and the free edge (6) of the container (1) and the length of said panel (13*a*) is equal to or smaller than 2, optionally comprised between 0.05 and 1, still more optionally comprised between 0.2 and 1; in which the predetermined length of the panel is measured along said predetermined longitudinal direction.

In a further aspect in accordance with any one of the preceding aspects the tab (12*a*) faces the lateral wall (104) of the case with which said tab is directly carried, optionally integrally joined.

In a further aspect in accordance with any one of the preceding aspects each tab (12*a*) of the first coupling portion (12) is extended substantially along a plane. In a further aspect in accordance with any one of the preceding aspects the extension plane of the tab (12*a*) is substantially parallel to a lying plane of the lateral wall (104) of the case (102) directly carrying said tab. In a further aspect in accordance with any one of the preceding aspects the extension plane of the tab (12*a*) is tilted with respect to a lying plane of the lateral wall directly carrying said tab by an angle lower than 40°, optionally comprised between 1° and 30°; optionally said angle being measured between facing surfaces of the tab (12*a*) and of the lateral wall of the case directly carrying (optionally integrally joined) said tab (12*a*). In a further aspect in accordance with any one of the preceding aspects the panel (13*a*) of the second coupling portion (13) is extended along a plane.

In a further aspect in accordance with any one of the preceding aspects the package comprises an opening device configured for being inserted, at least in the locking condition of the safety device, in the internal volume of the case in interposition between at least one first coupling portion (12) and a second coupling portion (13) engaged with each other in order to allow the disengagement thereof.

In a further aspect in accordance with any one of the preceding aspects at least one of said through accesses (18) of the at least one release portion (17) comprises at least one slit configured for allowing the passage of at least one opening device configured for being inserted, at least in the locking condition of the safety device, in the internal volume of the case in interposition between at least one first coupling portion (12) and a second coupling portion (13) engaged with each other in order to allow the disengagement thereof. In a further aspect in accordance with any one of the preceding aspects the slit of the release portion is defined at least partly on the top wall of the case (102), distanced from the free edge (106) of the same case.

In a further aspect in accordance with any one of the preceding aspects the release portion, optionally the at least one through access of the release portion is defined on at least one lateral wall (104) of the case (102). In a further aspect in accordance with any one of the preceding aspects the release portion (17), optionally the through access (18) of the release portion (17), is configured for allowing, at least in the locking condition of the safety device (11), the direct access from outside of the package to at least one between said first and second coupling portion (12, 13) in order to allow the disengagement thereof.

In a further aspect, a process is provided of making a package (100) in accordance with any one of the preceding aspects. In a further aspect in accordance with the preceding aspect the process comprises the following steps:

arranging a first flat blank (50) made of sheet material, optionally made of paper sheet material, said first blank (50) comprising:
- a central sheet (51),
- a predetermined number of lateral sheets (52) integrally joined to the central sheet (51) and emerging from the latter starting from a perimeter edge,
- at least one peripheral sheet (53) engaged with at least one of said lateral sheets (52), folding the predetermined number of lateral sheets (52) in order to define the predetermined number of lateral walls (104) of the case (102), defining the first coupling portion (12) of the safety device (11) by means of the peripheral sheet (53) of the first blank (50), arranging a second flat blank (70) made of sheet material, optionally made of paper sheet material, said second blank (70) comprising:
- a central sheet (71),
- a predetermined number of lateral sheets (72) integrally joined to the central sheet (71) and emerging from the latter starting from a perimeter edge, folding the predetermined number of lateral sheets (72) in order to define the predetermined number of lateral walls (4) of the container (1), defining, at at least one of said lateral walls (4) of the container, at least the second coupling portion (13) of the safety device (11), arranging at least one release portion (17) on at least one lateral wall (104) of the case (102).

In a further aspect in accordance with any one of the preceding aspects the second blank (70) is distinct from the first blank (50). In a further aspect in accordance with any one of the preceding aspects the central sheet (51) of the first blank (50) has a rectangular shape. In a further aspect in accordance with any one of the preceding aspects each lateral sheet of the first and/or second blank has a rectangular shape.

In a further aspect in accordance with any one of the preceding aspects the folding of the lateral sheets (52) of the first blank (50) defines the front wall (104*a*), the rear wall (104*b*), the first and the second lateral wall (104*c*, 104*d*) of the case (102), the central sheet (51), following the folding of the lateral sheets (52), of the first blank (50) defining the top wall (109).

In a further aspect in accordance with any one of the preceding aspects the peripheral sheet (53) is integrally joined with at least one lateral sheet (52) of the first blank (50), the peripheral sheet (53) of the first blank (50) emerging from a perimeter edge of at least one lateral sheet (52) of the first blank (50) itself on the side opposite the central sheet (51) of the first blank, wherein the step for defining the first coupling portion (12) provides for the folding of the peripheral sheet (53) of the first blank (50) above the lateral sheet (52) of the same first blank (50) with which said peripheral sheet (53) is integrally joined.

In a further aspect in accordance with any one of the preceding aspects the first blank (50) comprises at least two peripheral sheets (53) engaged respectively with opposite lateral sheets (52) of the first blank (50) itself with respect to the central sheet (51).

In a further aspect in accordance with any one of the preceding aspects the process comprises the following steps:

folding and constraining each peripheral sheet (53) above the lateral sheet with which said peripheral sheet is directly connected, optionally integrally joined, subsequently folding the lateral sheets to define the lateral walls (104) of the case (102) in a manner such that each peripheral sheet (53) defines a respective first coupling portion (12) placed substantially in the internal volume of the case.

In a further aspect in accordance with any one of the preceding aspects each peripheral sheet (53) comprises a first and a second portion (53*a*, 53*b*) that are distanced and flanked each other and engaged with a same lateral sheet (52), said first and second portion (53*a*, 53*b*) of said peripheral sheet (53) defining the flanked tabs of the first coupling portion (12).

In a further aspect in accordance with any one of the preceding aspects the step of arranging the release portion (17) comprises at least one step of defining a notch (56) of at least one lateral sheet (52) of the first blank configured for defining the through access (18). In a further aspect in accordance with any one of the preceding aspects the notch (56) is of the type passing through the lateral wall (52), said notch being executed on the lateral wall (52) carrying the peripheral sheet (53).

In a further aspect in accordance with any one of the preceding aspects the first blank (50) comprises at least one connection sheet (55) which integrally joins two adjacent lateral sheets (52).

In a further aspect in accordance with any one of the preceding aspects in which, following the folding of the lateral sheets (52) of the first blank (50), two adjacent adjacent lateral sheets are stably constrained, for example by means of gluing, in a manner such that the case can stably maintain a three-dimensional configuration. In a further aspect in accordance with any one of the preceding aspects wherein the process also comprises, simultaneously with the folding of the lateral sheets, the superimposition and the joining, for example by means of gluing, of the connection sheet (55) to folded adjacent lateral sheets.

In a further aspect in accordance with any one of the preceding aspects the central sheet (71) of the second blank (70) has a rectangular shape, wherein the second blank (70) comprises a lateral sheet (72) for each side of the central sheet (71), optionally each lateral sheet also has a rectangular shape. In a further aspect in accordance with any one of the preceding aspects the folding of the lateral sheets (72) of the second blank (50) defining the front wall, the rear wall, the first and the second lateral part (4*c*, 4*d*) of the container (1). In a further aspect in accordance with any one of the preceding aspects the central sheet (71), following the folding of the lateral sheets (72) of the second blank (70), defines the bottom wall (9) of the container.

In a further aspect in accordance with any one of the preceding aspects wherein, the step for defining the second coupling portion (13) comprises:

- arranging a peripheral sheet (73) integrally joined with at least one of said lateral sheets (72) of the second blank (70), said peripheral sheet (73) of the second blank (70) emerging from a perimeter edge of at least one lateral sheet (72) of the second blank (70) itself on the side opposite the central sheet (51) of the second blank,
- folding said peripheral sheet (73) above said lateral sheets (72) of the same second blank (70) with which said peripheral sheet (73) is integrally joined,
- constraining, for example by means of gluing, said folded peripheral sheet on the lateral sheet (72) of the same second blank (70) with which said peripheral sheet (73) is integrally joined.

In a further aspect in accordance with any one of the preceding aspects wherein, the step for defining the second coupling portion (13) comprises a step of executing a through notch (76) of one of said lateral sheets (72) of the second blank (70) in order to define, directly on said lateral sheet, the panel (13*a*) of the second coupling portion (13).

In a further aspect in accordance with any one of the preceding aspects the second blank (70) comprises at least one connection sheet (75) which integrally joins two adjacent lateral sheets (72).

In a further aspect in accordance with any one of the preceding aspects wherein, following the folding of the lateral sheets (72) of the second blank (70), two adjacent lateral sheets are stably constrained, for example by means of gluing, in a manner such that the container (1) can stably maintain a three-dimensional configuration.

In a further aspect in accordance with any one of the preceding aspects wherein the process also comprises, simultaneously with the folding of the lateral sheets (72) of the second blank, the superimposition and the joining, for example by means of gluing, of the connection sheet (75) to folded adjacent lateral sheets (72).

In a further aspect, a method for closing a package in accordance with any one of the preceding aspects. In a further aspect in accordance with the preceding aspect the closing method comprises the following steps:

- positioning the case (102) externally with respect to the container (1) in a manner such that the latter can be at least partly housed in the internal volume of the case (102),
- moving the case (102) and the container (1) relatively with respect to each other to define the closed condition,
- engaging the first and the second coupling portion (12, 13) of the safety device (11) in order to define the locking condition.

In a further aspect in accordance with any one of the preceding aspects wherein—before the step of positioning the case (102) outside the container (1)—said case and container are completely separate and distinct from each other. In a further aspect in accordance with any one of the preceding aspects wherein the relative movement between case and container provides for the relative translation of the case (102) with respect to the container up to an end stop position in which the top wall (109) of the case (102) is abutted against the free edge (6) of the container (1). In a further aspect in accordance with any one of the preceding aspects wherein, in the end stop position, the free edge (106) of the case (102) is arranged at the bottom wall (9) of the container (1).

In a further aspect, a method is provided for opening a package in accordance with any one of the preceding aspects.

In a further aspect in accordance with the preceding aspect the opening method comprises the following steps:

- contacting, in the locking condition and from outside of the package (100), at least one between the first and the second coupling portion (12, 13) through the release portion (17),
- disengaging the first and the second coupling portion (12, 13),
- following the step for disengaging the first and the second coupling portion (12, 13), moving the container (1) and the case (102) relatively away from each other up to reaching the open condition of the case (102).

In a further aspect in accordance with any one of the preceding aspects wherein, the step of contacting at least one between the first and the second coupling portion (12, 13) comprises at least one between the following sub-steps:

- inserting at least one opening device through the through access (18) of the release portion (17),
- manually contacting at least one between the first and the second coupling portion (12, 13), for example by means of insertion of a finger of a user through the through access (18) of the release portion (17), deforming a thrust portion of the same case (102) in a manner such that such thrust portion may contact at least one between the first and the second coupling portion (12, 13).

In a further aspect in accordance with any one of the preceding aspects, the disengagement step comprises the thrust of the second portion of the container (1) in moving closer to the compartment (3), optionally by means of a manual intervention of a user or by means of an opening device.

In a further aspect, a use of the package is provided in accordance with any one of the preceding aspects for containing products comprising at least one selected in the group from among: drugs, cosmetics, detergents for linens/sheets, detergents for dishes, foods, cigars, cigarettes.

DESCRIPTION OF THE DRAWINGS

Several embodiments and several aspects of the finding will be described hereinbelow with reference to the enclosed drawings, provided only as an example and therefore non-limiting, in which:

FIG. 2 is a perspective view of a package arranged in an open condition;

FIG. 3 is a perspective detailed view of a case of a package in accordance with the present invention;

FIG. 9 shows a further embodiment variant of a container of a package in accordance with the present invention;

FIG. 10 schematically shows a step for opening the package comprising the container in accordance with FIG. 9;

DEFINITIONS AND CONVENTIONS

Figure 1A:
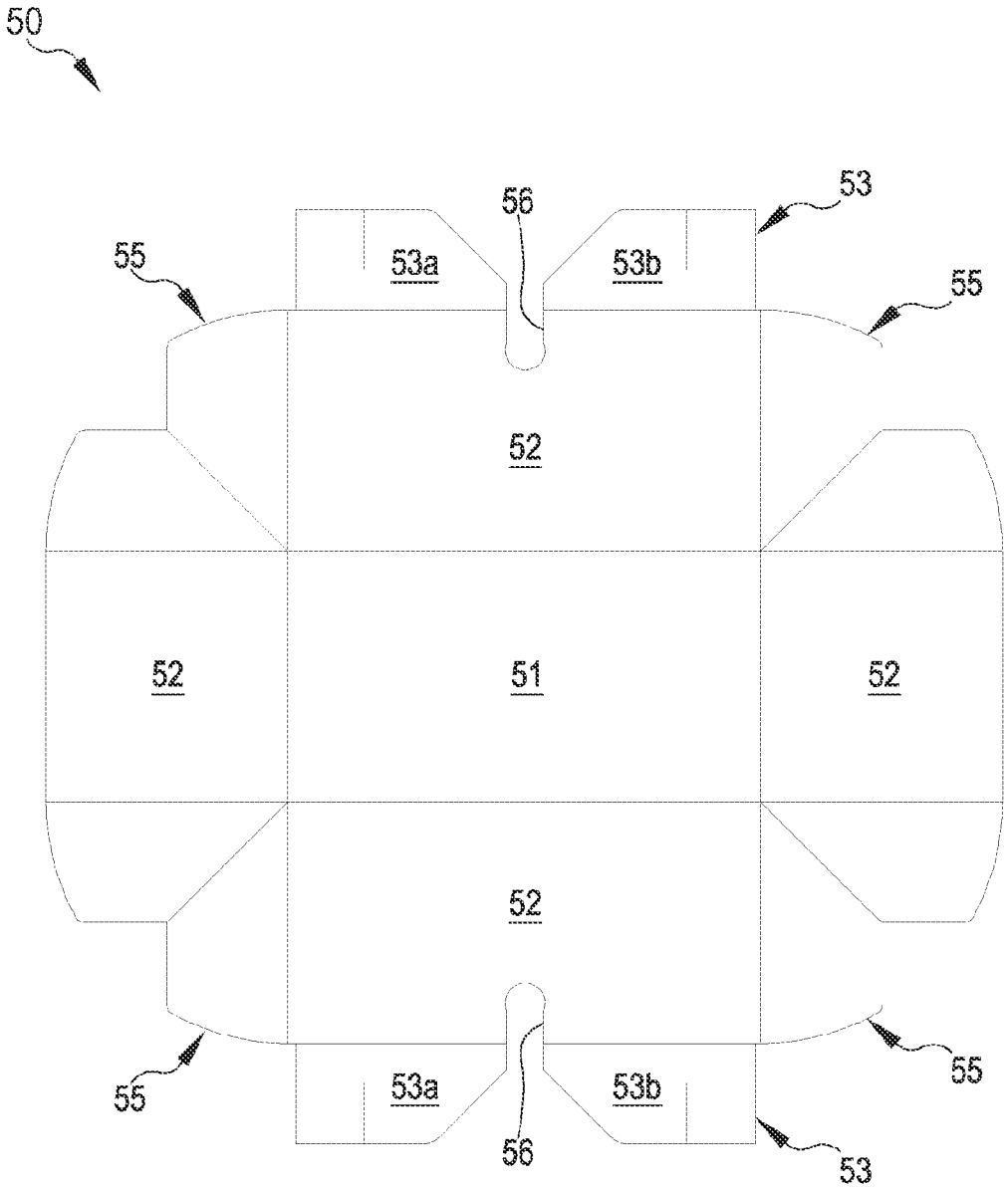
FIGS. 1A and 1B respectively illustrate a blank for making a container and a case of a child-proof package in accordance with the present invention.

It is observed that in the present detailed description, corresponding parts illustrated in the various figures are indicated with the same numeric references. Figures could illustrate the object of the invention by means of representations that are not in scale; therefore, parts and components illustrated in the figures relative to the object of the invention might exclusively regard schematic representations.

With the term 'product' it is intended an article or a compound of articles of any kind. For example, the product can comprise a package, for example a blister, carrying a plurality of articles. The product can comprise: drugs, cosmetic products, capsules for dishwashers and washing machines, cleaning products for the home and for linens/sheets (e.g. detergents), foods and cigarettes.

With the term 'paper material' it is intended paper or cardboard, for example having at least 50% by weight, optionally at least 70% by weight, of organic material comprising one or more from among cellulose, hemicellulose, lignin, lignin derivatives. The paper material can be made of sheet material having a basis weight comprised between 100 and 500 g/m$^2$. The paper sheet material can be covered at least partly by means of a coating made of plastic material, e.g. a film, whose object is that of: reinforcing the paper sheet material, defining a water or moisture barrier. The coating can have a thickness variable between 10 and 50 μm and can be made with one or more of the following materials: LDPE, HDPE, PP, PE.

The term 'blank' refers to a flat semifinished product made of sheet material, e.g. paper, foldable on itself in order to make the package or one or more parts of said package. The blank can be made of a single piece and obtainable by means of die cutting a single sheet.

With the term 'opening device', it is intended any one tool usable by a user for the opening of the package. For example, the opening device can comprise at least one from among: a body made of sheet material (e.g. a payment card, a loyalty card or a suitable key), an elongated body (e.g. a pen or a suitable key).

With the term 'manually intervening' or 'manual intervention' referred to the user, it is intended a manual action performed by the user without the aid of tools, such as an opening device. With manual action it is therefore intended the intervention of the user by means of his/her hands directly on the container.

DETAILED DESCRIPTION

Package 100

With 100, a child-proof package for containing products was indicated in its entirety. Such package can have application in the fields which require, for safety reasons, preventing the opening of the same package by children.

As is visible in FIGS. 2, 5-8, the package 100 comprises a container 1 made of sheet material, e.g. paper, defining a compartment 3 for housing at least one product. The container 1 has a predetermined number of lateral walls 4 defining at least one opening 5 delimited by a free edge 6: the opening 5 is configured for allowing the insertion and the picking up of the product from the container 1.

The container 1 may have a rectangular prismatic shape, not excluding in any case the possibility to make a container 1 having different shape, for example square, trapezoidal or cylindrical. The container 1 can comprise a front lateral wall 4*a* and a rear lateral wall 4*b* facing and parallel to each other: the front wall 4*a* and the rear wall 4*b* are connected to each other by means of a first and a second lateral wall 4*c*, 4*d*, also facing and parallel to each other. The front wall 4*a* is distanced from and opposite the rear wall 4*b*; the first and second lateral wall 4*c*, 4*d* are also distanced and opposite each other. The upper transverse edges of the front, rear and lateral walls (4*a*, 4*b*, 4*c*, 4*d*) define the opening 5, delimited by the free edge 6.

The container 1 also comprises a bottom wall 9 from which the lateral walls 4 emerge, starting from a perimeter edge of the bottom wall 9, and in particular the front wall 4*a*, the rear wall 4*b* and the first and second lateral part 4*c*, 4*d*. The container 1 then comprises a single opening 5 defined opposite the bottom wall 9. However the possibility of making a container 1 having two or more openings 5 cannot be excluded. From a size standpoint, the compartment 3 can have a volume greater than 40 $cm^3$, optionally greater than 100 $cm^3$ as a function of the products to be contained. For example, if the container 1 is used for containing mid-size products, the compartment 3 can have a volume comprised between 800 and 1400 $cm^3$. For large-size products, the compartment 3 can reach volumes greater than 10,000 $cm^3$. The package 100 comprises a case 102 that can be made of sheet material, e.g. paper, and having a predetermined number of lateral walls 104 defining at least one access 105 delimited by a free edge 106 configured for allowing the passage of the container 1. The predetermined number of lateral walls 104 of the case 102 delimits an internal volume 103 configured for receiving at least part of the container 1; in fact, the access 105 is configured for placing in communication the internal volume 103 with the external environment, as well as allowing the insertion and the removal of the container 1 from said internal volume 103. The case 102 and the container 1 are defined as elements separate from each other and completely separable, as schematized in FIG. 2. In particular, case 102 and container 1 are relatively movable with respect to each other at least between:

- a closed condition in which the case 102 obstructs the opening 5 of the container 1, and
- an open condition in which the case 102 allows the communication between the compartment 3 and the external environment.

The relative movement between case and container can be obtained by moving both parts, i.e. both the case and the container or it can be obtained by means of the movement of only one of the parts: for example, it is possible to maintain the container fixed and only move the case relative to the container.

In detail, the container 1, in the closed condition (schematized for example in FIGS. 5-6A and 15), is at least partly arranged in the internal volume 103: the case 102, in such condition, prevents the insertion and the picking up of products from the container. In the open condition, the case 102 is completely separated (distanced) from the container 1, as is visible for example in FIG. 2. During the passage from the closed condition to the open condition, and vice versa, container 1 and case 102 slide with respect to each other in moving closer to or away from each other: during such relative movement, the container 1 is at least partly placed within the case 102 and translates in a relative manner (due to movement of at least one between said container and case) in a manner such that the bottom wall 9 of the container 1 and the top walls 109 of the case 102 are moved closer to or away from each other.

The case 102 has a structure at least partly counter-shaped to the container 1 in a manner such that, in the closed condition, the case 102 is fit externally with respect to the container 1. In detail, the case 102 comprises a front wall 104*a* and a rear wall 104*b* that are opposite each other and connected by means of a first and a second lateral wall 104*c* and 104*d*, also distanced and opposite each other. In detail, also the case 102 has a rectangular prismatic shape: the front wall 104*a* and the rear wall 104*b* (with square or rectangular shape) face and are parallel to each other and connected to each other by means of the first and of the second lateral wall 104*c*, 104*d* (with square or rectangular shape), also facing and parallel to each other. In the closed condition:

- the front walls 4*a*, 104*a*, respectively of the container and of the case, are directly facing each other,
- the rear walls 4*b*, 104*b*, respectively of the container and of the case, are directly facing each other,
- the first lateral walls 4*c*, 104*c*, respectively of the container and of the case, are directly facing each other,
- the second lateral walls 4*b*, 104*d*, respectively of the container and of the case, are directly facing each other.

However the possibility of making a case 102 having different shape, e.g. with trapezoidal section, cannot be excluded.

Figure 5:
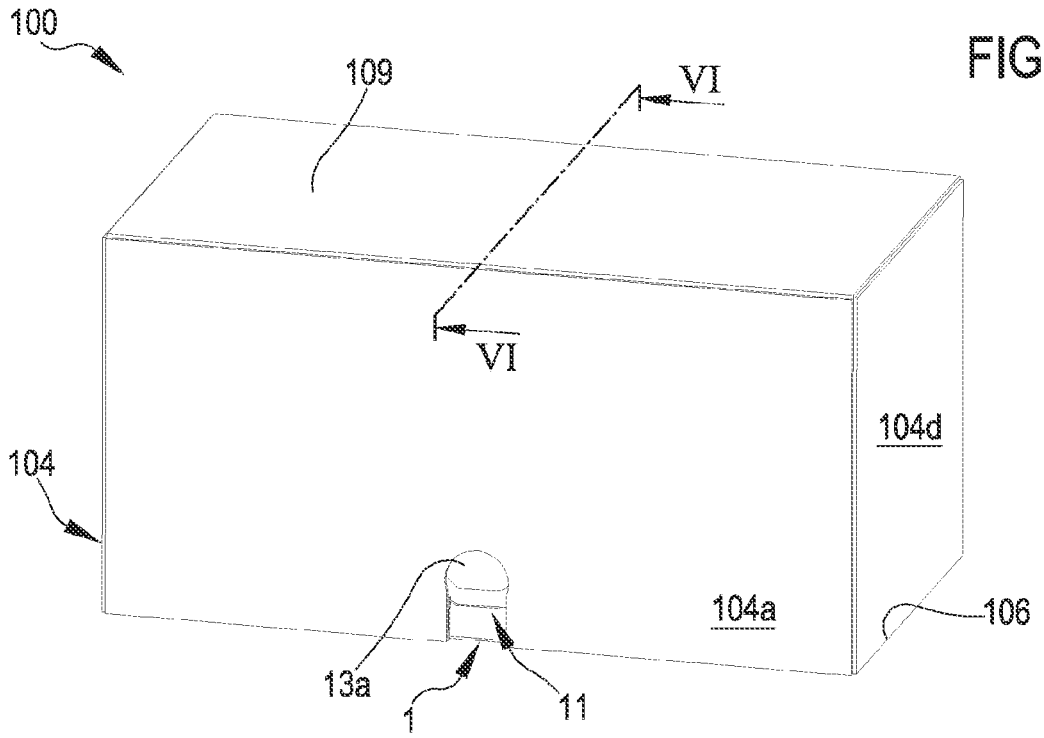
FIG. 5 is a further perspective view of the package arranged in a closed condition.
Figure 6:
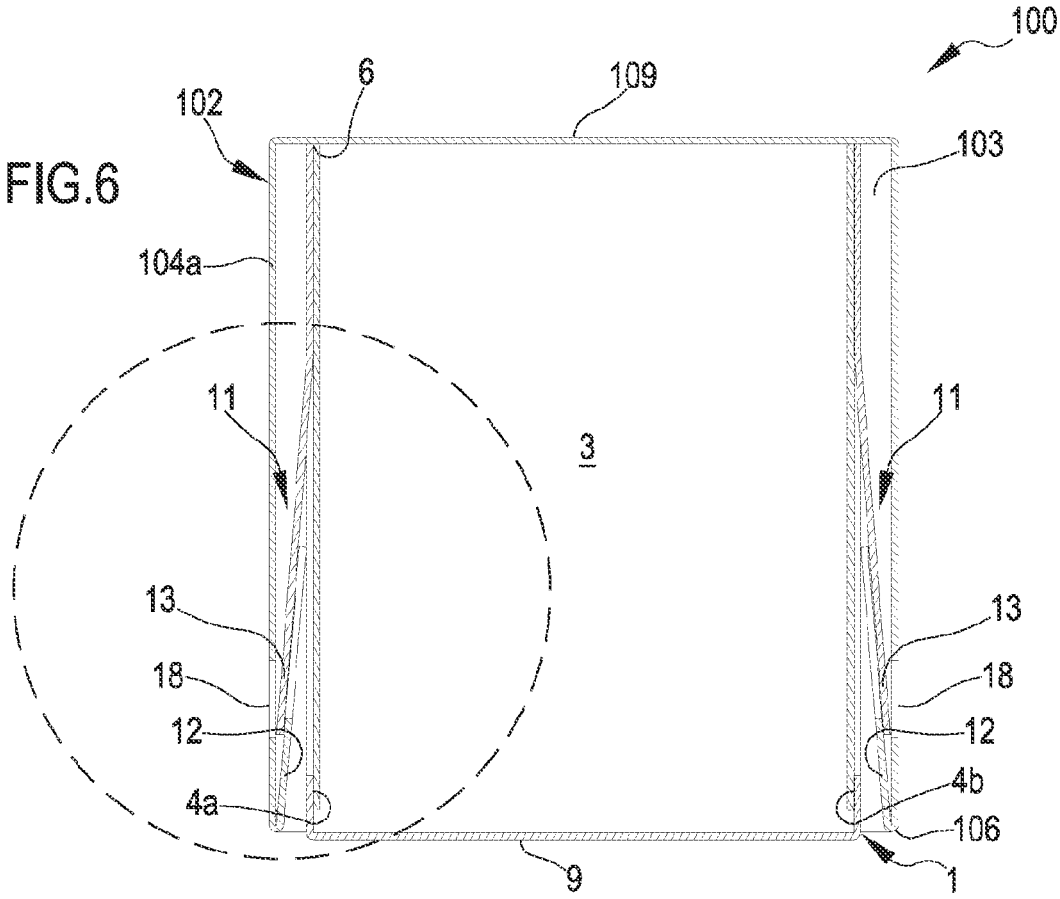
FIG. 6 is a detailed section view, according to trace VI-VI, of the package of FIG. 5.
Figure 15:
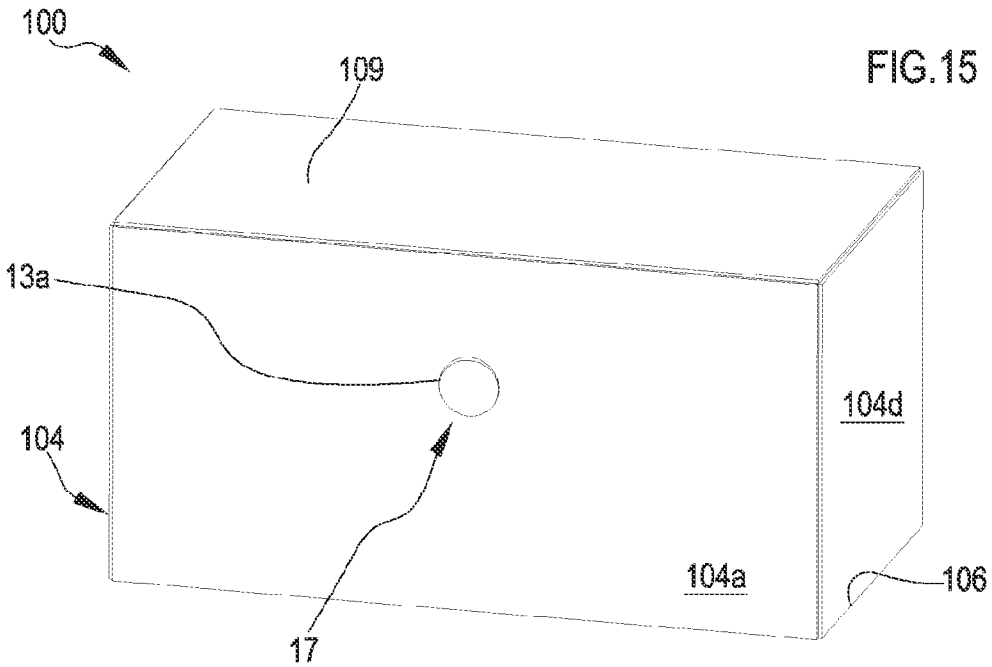
FIG. 15 is a further perspective view of a package arranged in a closed condition.
Figure 16:
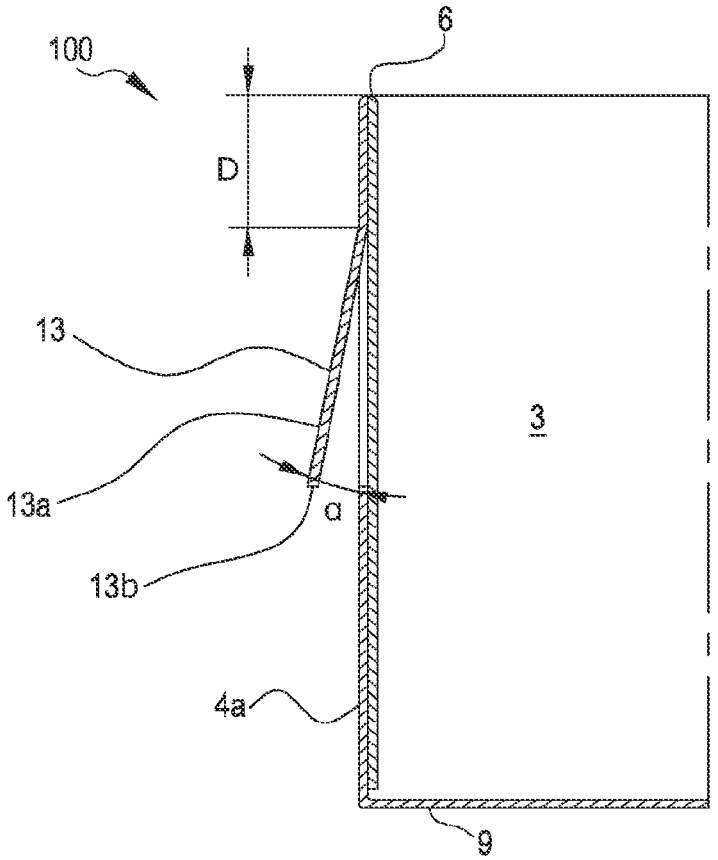
FIG. 16 is a schematic section of a container of a package in accordance with the present invention.

As is visible for example in FIGS. 5, 6 and 15, the case 102 also comprises a top wall 109 having rectangular shape and from which the lateral walls 104 emerge, starting from a perimeter edge of the top wall 109, and in particular the front wall 104*a*, the rear wall 104*b* and the first and second lateral part 104*c*, 104*d*. The case 102 then comprises a single access 105 defined opposite the top wall 109. However the possibility of making a case 102 having two or more accesses 105 cannot be excluded; for example, the case 102 could have an access 105 on at least one of the lateral walls 104*c*, 104*d* of the same case 102. The top wall 109 is configured for being abutted, in the closed condition, against the free edge 6 of the opening 5 in order to obstruct the latter, as is visible in FIG. 6.

As mentioned above, the case 102 is counter-shaped with respect to the container 1. The counter-shaped configuration of container 1 and case 102 allows the lateral walls of the case 102 to slide (relatively) externally and side-by-side the lateral walls 4 of the container 1 during the passage from the closed condition to the open condition (FIG. 8), and vice versa. In order to allow such relative movement, the case 102 has a slightly larger size than the container 1, sufficient for allowing the insertion of the latter in the internal volume 103.

The package 100 also comprises a safety device 11 comprising:

- at least one first coupling portion 12 carried by the case 102 which is substantially at least partly arranged in the internal volume 103,
- at least one second coupling portion 13 carried by the container 1 and arranged outside the compartment 3.

The first and the second coupling portion 12, 13 are configured for being stably engaged with each other, externally with respect to the container 1, in the closed condition, to define a locking condition of the safety device 11 in which the first and second coupling portion 12, 13 prevent a container and case from passing from the closed condition to the open condition.

In detail, the first coupling portion 12 is engaged with at least one lateral wall 104 of the case 102 and emerges in the internal volume 103 according to a direction entering the latter. Indeed, the lateral wall 104 defines an external wall of the case delimiting said internal volume while the coupling portion is carried by said lateral wall in a manner such to be substantially arranged in the internal volume.

The first coupling portion 12 comprises at least one tab 12*a* emerging from the lateral wall 104 to define an undercut delimited by at least one gripping edge 12*b* placed entirely in the internal volume 103, distinct and distanced from the free edge 106 of the access 105. The tab 12*a* can have a substantially trapezoidal shape. The gripping edge 12*b* has at least one section tilted with respect to the free edge 106 of the access 105 optionally by an angle comprised between 20° and 80°, still more optionally by an angle comprised between 30° and 70°. In detail, the tab 12*a* is extended along a plane and directly faces the lateral wall 104 of the case directly carrying the tab 12*a*. The tab 12*a* can be substantially parallel or tilted with respect to the lateral wall 104 directly carrying said tab 12*a* by an angle lower than 40°, optionally by an angle comprised between 1° and 30°. Said angle being measured between the surface of the tab 12*a* directly facing the lateral wall 104 of the case 102 and the same lateral wall 104 of the case 102 directly carrying (directly integrally joined) said tab 12*a*.

In the enclosed figures, a first coupling portion 12 (at least one tab 12 *a*) has been illustrated, directly integrally joined with at least one lateral wall 104 by means of a folding edge to define a folded portion. In fact, the tab 12 *a* is integrally made with a lateral wall 104 and folded with respect to the latter in a manner such that the tab is at least partly superimposed and facing the lateral wall 104 with which said tab is directly connected (integrally joined). In such configuration, the folding edge 12*d*, e.g., a fold line, joining the tab 12*a* and the lateral wall 104, defines at least part of the free edge 106 of the access 105. Even if the tab 12 *a* is integrally joined with the lateral wall 104, only a part of this defines the undercut adapted to cooperate with the second coupling portion 13: the gripping edge 12*b*, e.g., free edge of tab 12, is always distinct and distanced from the free edge 106 of the access 105.

In fact, the at least one tab 12*a* entirely faces (directly) the lateral wall 104 of the case directly carrying said tab 12*a*: the tab 12*a* is entirely superimposed on said lateral wall 104 of the case 102 directly integrally joined with the tab 12*a*, and distanced from the free edge 106.

As is visible from the enclosed figures, the first coupling portion 12 can comprise two tabs 12 *a* distanced and side-by-side each other. As is visible for example in FIGS. 2 and 3, the two tabs 12 *a* are engaged with the same lateral wall 104 of the case 102 and are substantially identical to each other regarding shape and size: the two tabs 12 *a* are symmetrical with each other and have respective gripping edges 12 *b* facing each other and separated by a gap 12 *c*. The gripping edges 12 *b* of the two tabs 12 *a* are distanced from each other and positioned entirely in the internal volume 103, distanced from the free edge 106 of the access 105: the gripping edges 12 *b* of the two tabs 12 *a* of the first coupling portion 12 define a substantially V-shaped form whose concavity is directed on the opposite side with respect to the access 105. In fact, the gripping edge 12 *b* of each first coupling portion 12 is arranged in interposition between the top wall 109 and the access 105 of the case 102. The gripping edges 12 *b* face the lateral wall 104 of the case 102 directly carrying (directly integrally joined) the tab 12 *a*, distanced both from the free edge 106 and from the top wall 109.

As mentioned above, the safety device 11 can comprise at least one first coupling portion 12. In detail, the safety device 11 can comprise at least one of the following:

- at least one of said first coupling portion 12 carried by the front wall 104*a* of the case 102,
- at least one of said first coupling portion 12 carried by the rear wall 104*b* of the case 102,
- at least one of said first coupling portion 12 carried by the first lateral wall 104*c* of the case 102,
- at least one of said first coupling portion 12 carried by the second lateral wall 104*c* of the case 102.

In the enclosed figures, a non-limiting configuration of the invention was illustrated in which the safety device 11 comprises a first coupling portion 12 carried by the front wall 104*a* and a respective first coupling portion 12 carried by the rear wall 104*b*: said first coupling portions 12 are placed opposite each other. Of course, the possibility of arranging two or more first coupling portions 12 on the same lateral wall and/or at least one first coupling portion for each lateral wall 104 of the case 102 cannot be excluded.

As mentioned above, the safety device 11 comprises at least one second coupling portion 13. In particular, the safety device 11 could comprise only one second coupling portion 13 configured for cooperating with one or more of said first coupling portions 12. Alternatively, the safety device 11 can comprise a second coupling portion 13 for each first coupling portion 12 (non-limiting configuration illustrated in the enclosed figures).

The second coupling portion 13 is carried by at least one lateral wall 4 of the container 1 and emerges from the latter according to a direction that is exiting with respect to the compartment 3. The second coupling portion 13 comprises at least one panel 13*a* projecting from the lateral wall 4 to define an undercut delimited by at least one gripping edge 13*b* placed externally with respect to the compartment 3, distinct and distanced from the free edge 6 of the opening 5. The panel 13*a* can have a substantially rectangular or triangular shape or substantially trapezoidal shape or substantially V-shaped or C-shaped: in which the gripping edge 13*b* has at least one section, optionally two rectilinear sections, tilted with respect to the free edge 6 of the opening 5 optionally by an angle comprised between 20° and 80°, still more optionally by an angle comprised between 30° and 70°. In more detail, the free edge 13*b* of the panel 13*a* has a substantially V-shaped or C-shaped form whose concavity is directed towards the free edge 6 of the container. In the embodiment illustrated in FIG. 4B, the panel 13*a* is extended substantially along a surface and directly faces the lateral wall 4 of the container 1 directly carrying the panel 13*a*; the panel 13*a* can be tilted with respect to the lateral wall 4 directly carrying said panel 13*a* by an angle lower than 40°, optionally by an angle comprised between 1° and 30°. The angle is measured between the surface of the panel 13*a* directly facing the lateral wall 4 and the same lateral wall 4 of the container 1 directly carries (directly integrally joined) said panel 13*a*. The second coupling portion 13 can be directly integrally joined with at least one of said lateral walls 4 of the container 1 by means of a folding edge to define a folded portion. In such configuration, the panel 13*a* is integrally made with a lateral wall 4 and folded with respect to the latter in a manner such that the panel 13*a* is at least partly superimposed and facing the lateral wall 4 with which said panel 13*a* is directly connected (integrally joined). Even if the panel 13*a* is integrally joined to the lateral wall 4, only a part of said panel 13*a* defines the undercut adapted to cooperate with the first coupling portion 12: the gripping edge 13*b* is always distinct and distanced from the free edge 6 of the opening 5 (FIG. 4B). In fact, in such configuration the at least one panel 13*a* of the second coupling portion 13 is directly and entirely facing the lateral wall 4 of the container directly carrying said panel 13*a*: the panel 13*a* is entirely superimposed on the lateral wall 4 of the container 1 directly integrally joined to the panel 13*a*, and distanced from the free edge 6.

Figure 4A:
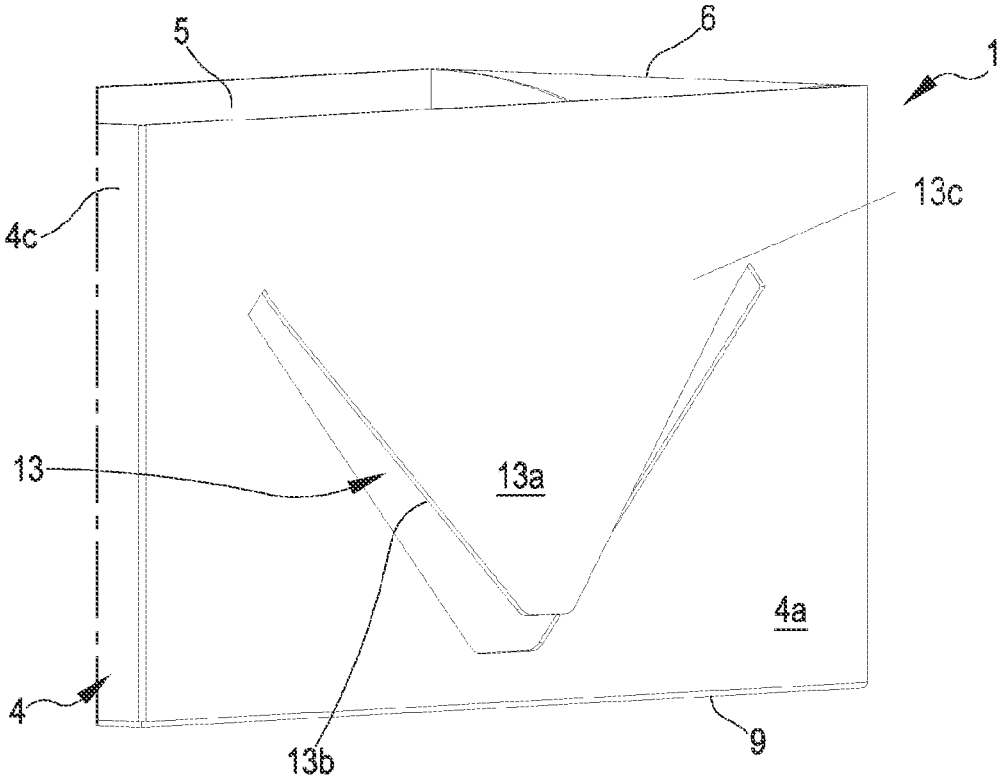
FIGS. 4A and 4B are respective detailed perspective views relative to different embodiments of a coupling portion of a container of a package in accordance with the present invention.
Figure 4B:
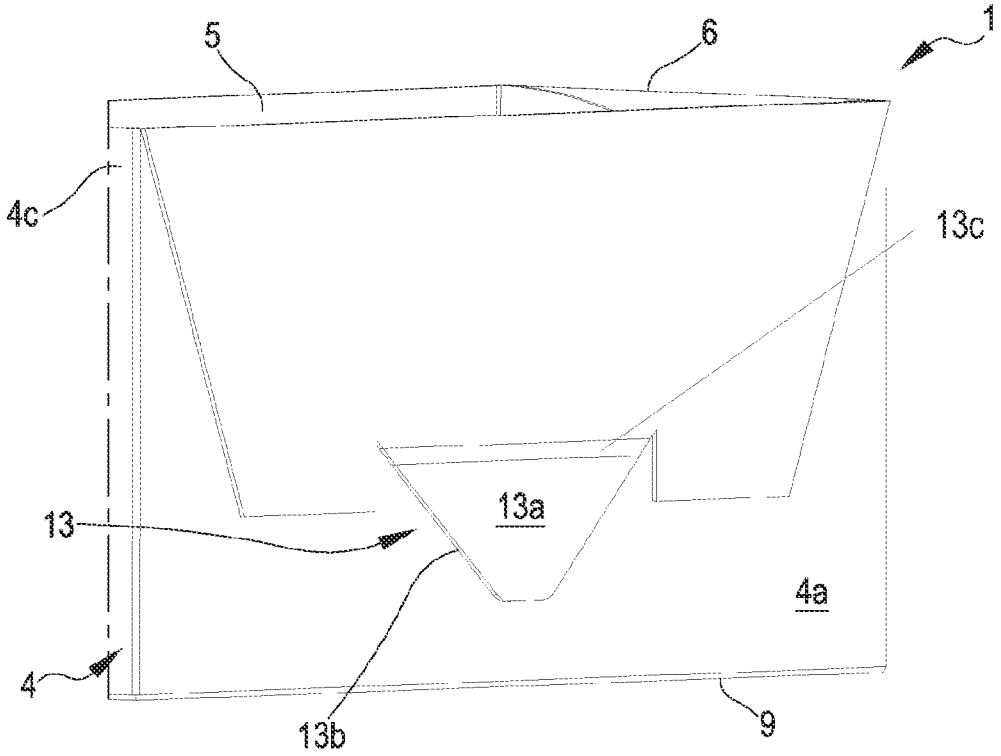

In FIG. 4A, a second coupling portion 13 is illustrated which is defined directly on lateral wall 4; in detail, the second coupling portion 13 is made on the lateral wall, defining an external wall of the container by means of an operation of through cut of said lateral wall 4: in this manner, on said lateral wall, it is possible to extract the panel 13*a* which projects with respect to said lateral wall as illustrated in FIG. 4A. In such configuration, the entire panel

13*a* can be extended from the lateral wall 4, distanced from the free edge 6, in moving away from the latter by an angle α lower than 40°, optionally comprised between 1° and 30°, with respect to the lateral wall 4 from which the same panel 13*a* was obtained. In fact also in such configuration (FIG. 4A), the panel 13*a* is at least partly defined within a through notch of the lateral wall 4; the panel 13*a* has an attachment portion 13*c* distanced from the free edge and integrally joined with the lateral wall 4: the panel is extended from said attachment portion 13*c* in moving away from the free edge 6 of the container. In detail, the coupling portion 13, optionally the panel 13*a*, is placed at a minimum distance of the free edge 6 of the container 1 equal to or greater than 5 mm, optionally equal to or greater than 7 mm, still more optionally comprised between 7 mm and 30 mm. In fact, the minimum distance is measured (defined) by the attachment portion 13*c* for attaching the panel 13*a* to the free edge 6.

Each second coupling portion 13 comprises one and only one panel 13*a* adapted to cooperate with the first coupling portion 12 and optionally adapted to be interposed (fit) between the two side-by-side tabs 12*a*. As mentioned above, the safety device 11 can comprise at least one second coupling portion 13. In detail, the safety device 11 can comprise at least one of the following:

- at least one of said second coupling portion 13 carried by the front wall 4*a* of the container 1,
- at least one of said second coupling portion 13 carried by the rear wall 4*b* of the container 1,
- at least one of said second coupling portion 13 carried by the first lateral wall 4*c* container 1,
- at least one of said second coupling portion 13 carried by the second lateral wall 4*c* of the container 1.

In the enclosed figures, non-limiting configuration of the invention was illustrated in which the safety device 11 comprises a second coupling portion 13 carried by the front wall 4*a* and a respective second coupling portion 13 carried by the rear wall 4*b*: said second coupling portions 13 are placed opposite each other.

As is visible in FIG. 9, the panel 13*a* can comprise two portions 13*a*' and 13*a*", each of which configured for engaging respectively with one of said tabs 12*a* to define the locking condition of the container 1 and of the case 102. The portions 13*a*' and 13*a*" can have a substantially triangular shape or substantially trapezoidal shape. The gripping edge 13*b* of each of said portions 13*a*', 13*a*" defines gripping edges having substantially V-shaped form whose concavity is directed towards the free edge 6 of the opening 5. The portion 13*a*' is also distanced from and adjacent to the portion 13*a*": the portions 13*a*' and 13*a*" are side-by-side and directly facing the same release portion 17 (at the same through access 18) of the case 102. Of course the possibility of arranging two or more second coupling portions which are distinct and distanced from each other, located on the same lateral wall and/or at least one first coupling portion for each lateral wall 4 of the container cannot be excluded.

Each panel 13*a* can be extended length-wise starting from a lateral wall 4 (optionally starting from the attachment portion 13*c*) of the container along a predetermined longitudinal direction to define a predetermined length of the panel 13*a* equal to or greater than 15 mm, optionally comprised between 15 mm and 100 mm; in which the predetermined length of the panel 13*a* is measured along said predetermined longitudinal direction. The ratio between the distance present between the panel 13*a* and the free edge 6 of the container 1 and the length of said panel 13*a* is equal to or smaller than 2, optionally comprised between 0.05 and 1, still more optionally comprised between 0.2 and 1; in which the predetermined length of the panel is measured along said predetermined longitudinal direction.

In the enclosed figures, the second coupling portion 13 carried by the front wall 4*a* of the container 1 is configured for cooperating, in the closed condition, with the first coupling portion 12 carried by the front wall 104*a* of the case while the second coupling portion 13 carried by the rear wall 4*b* of the container 1 is configured for cooperating, in the closed condition, with the first coupling portion 12 carried by the rear wall 104*b* of the case. In the closed condition the undercut defined by the panel 13*a* of the second coupling portion 13 is stably engaged with the undercut of the at least one tab 12*a* of the first coupling portion 12 to define said locking condition. In the locking condition, the safety device 11 prevents case and container from passing from the closed condition to the open condition. In fact, due to the presence of the first and second coupling portion, the safety device 11 stably maintains the package in the closed condition, preventing the access from the outside to the products housed in the container 1.

Figure 6A:
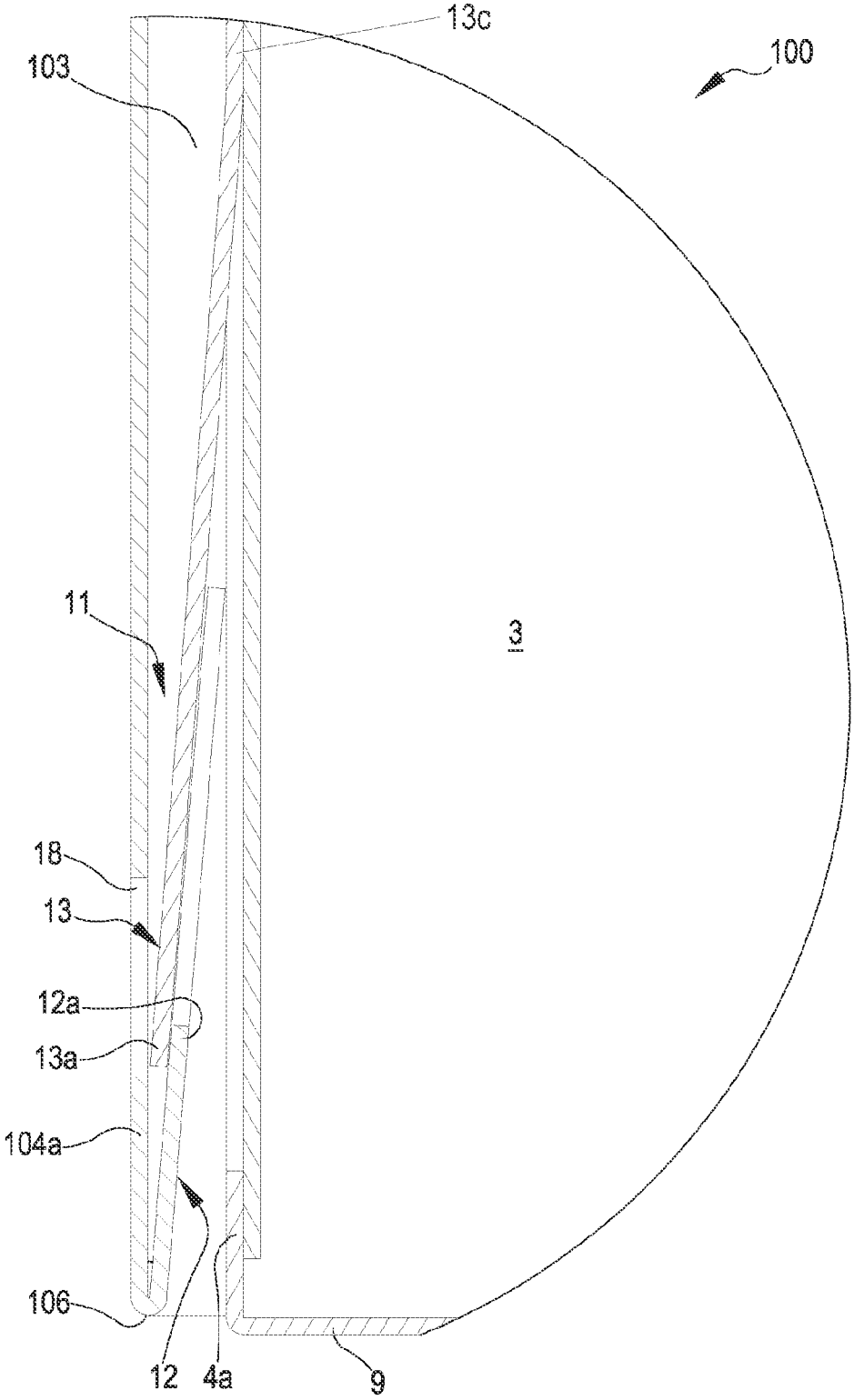
FIG. 6A is a detailed view of the package of FIG. 6.
Figure 7:
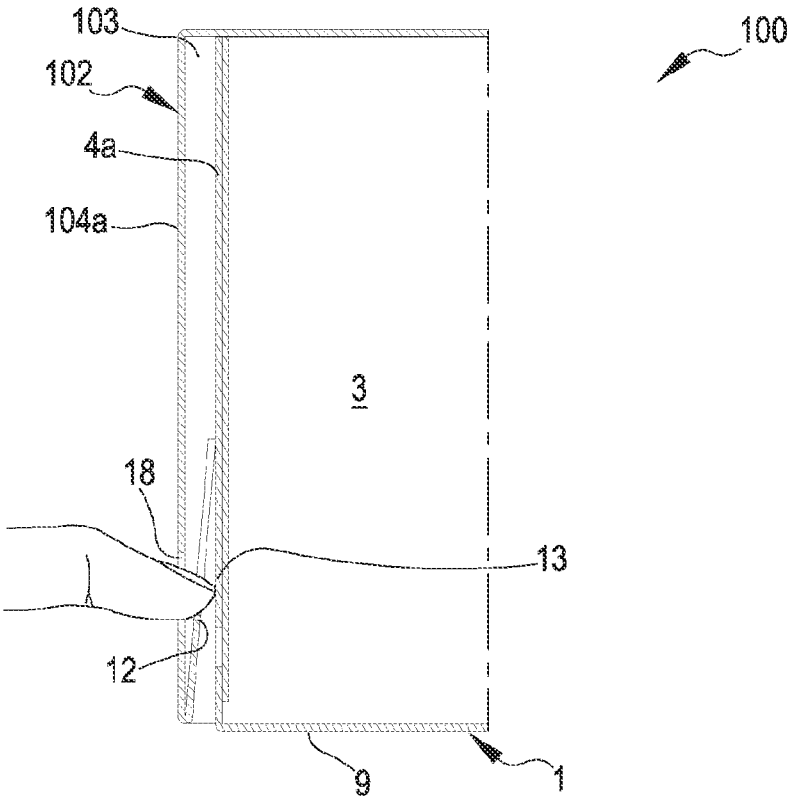
FIGS. 7 and 8 schematically show steps for opening a package in accordance with the present invention.
Figure 8:
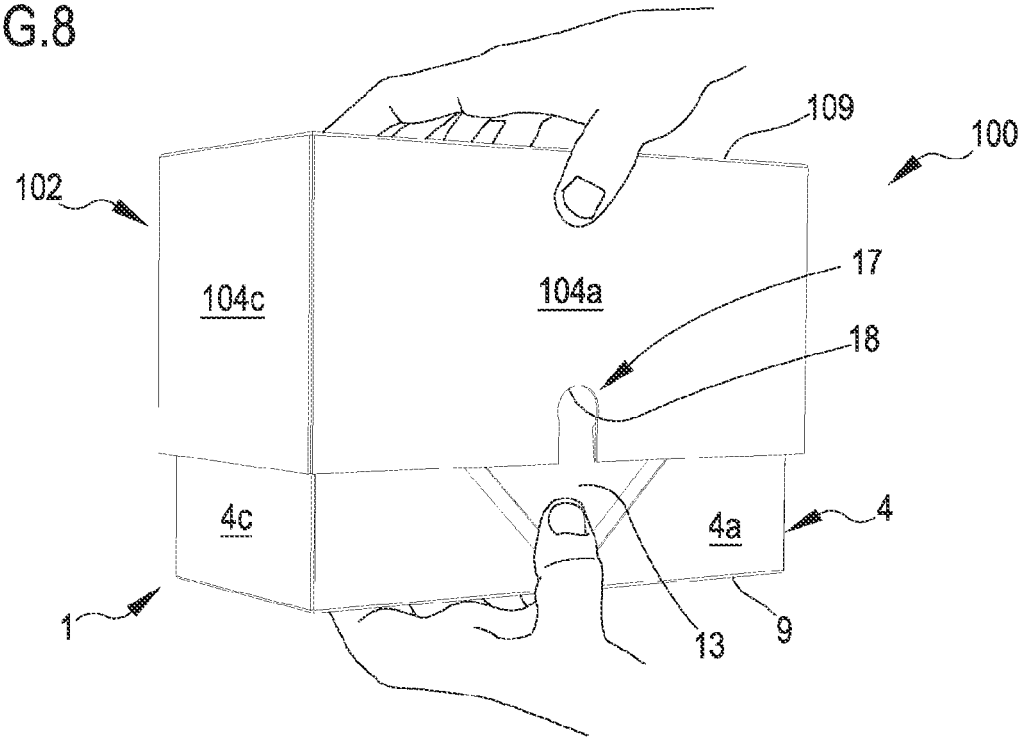

In FIGS. 6 and 6*a*, the locking condition of the first and second coupling portion 12, 13 is schematically illustrated; in the locking condition, the second coupling portion 13 is interposed between the first coupling portion 12 and the lateral wall 104 of the case 102, carrying said first coupling portion, to define an undercut adapted to limit the moving away movement between case 102 and container 1 so as to prevent the passage from the closed condition to the open condition. In more detail, in the locking condition, the panel 13*a* of the second coupling portion 13 can be substantially interposed between the two side-by-side tabs 12*a* of the first coupling portion 12; in this manner the panel 132 is configured for stably engaging the two edges 12*b* of the tabs 12*a* placed opposite with respect to each other.

As mentioned above, the panel 13*a* can have a substantially V-shaped form whose pointed portion is directed in moving away from the free edge 6. The pointed portion (end) of the V is configured for defining an introduction portion adapted to facilitate the engagement of the panel 13*a* in interposition between the at least one tab 12*a* of the first abutment portion 12 and the lateral wall 104 carrying said first engagement portion 12.

The safety device 11 also comprises at least one release portion 17 configured for defining at least one through access 18 on at least one lateral wall 104 of the case 102, at the first and second coupling portion 12, 13: the release portion 17 is configured for allowing, at least in the locking condition of the safety device 11, the direct access from outside of the package to at least one between said first and second coupling portion 12, 13 in order to allow the disengagement thereof and hence allow the passage of case 102 and container from the closed condition to the open condition.

In detail, the release portion 17 is configured for allowing a user, at least in the locking condition of the safety device 11, to intervene from outside the package 100 directly on at least one of said first and second coupling portion 12, 13 manually and/or by means of an opening device insertable through the through access 18. In still more detail, the release portion 17 is configured for allowing, at least in the locking condition of the safety device 11, intervention from outside the package 100 directly on the panel 13*a* of at least one of said second coupling portions 13. However the possibility that each of the portions 13*a*' and 13*a*" is respectively facing a first and a second release portion, that are adjacent and distanced with respect to each other, cannot be excluded.

The release portion 17 can comprise, in a non-limiting manner, a through access 18 defined on at least one lateral wall 104 of the case 102: the through access 18 is configured for allowing the communication between external environment and the internal volume 103 and specifically allows a user to reach the panel 13*a*, optionally the portions 13*a*' and 13*a*", in the locking condition of the safety device 11 and hence in the closed condition of case and container.

Figure 13:
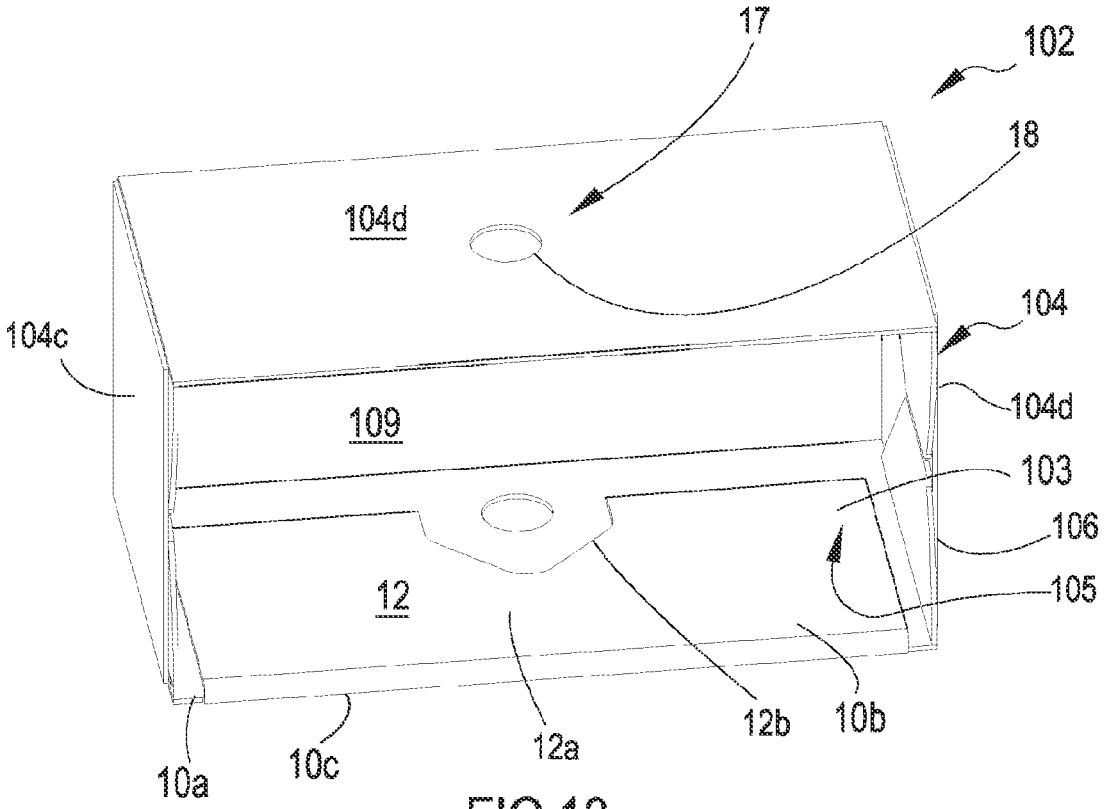
FIG. 13 is a further perspective view of a case of a package in accordance with the present invention.

The through access 18 of the release portion 17 can have an open perimeter profile; in such case, the through access 18 is integrally joined to the free edge 106 of the access 105 and essentially defines a groove of said free edge 106 (FIGS. 2, 3, 5, 8, 10). Alternatively, the through access 18 can be distinct and distanced from the free edge 106 of the case and has a shape, e.g. circular, with closed profile (FIGS. 13 and 15): in fact in the latter described configuration, the through access 18 is arranged in interposition between the free edge 106 and the top wall 109 of the case 102.

Furthermore, the release portion 17 could comprise a deformable portion, in the locking condition, in front of the first and second coupling portion 12, 13: in such configuration, the release portion 17 essentially comprises a thrust portion configured for being moved (manually by the user or by means of an opening device) between a thrust condition and a rest condition. In the rest condition, the thrust portion is distanced from the safety device, while in the thrust condition the thrust portion operates on the safety device in order to allow the disengagement between the first and the second coupling portion 12, 13 and consequently the passage of case and container from the closed condition to the open condition. In the thrust condition, the thrust portion contacts the second coupling portion 13 (the panel 13*a*, optionally the portions 13*a*' and 13*a*") and it allows the disengagement thereof with respect to the first coupling portion 12. In fact, the thrust portion can easily act as a button. The thrust of a finger of a user on the thrust portion according to a direction entering the package allows the thrust portion to come into contact with the second coupling portion 13, disengaging it from the undercut of the first coupling portion 12. The thrust portion can be reversibly mountable between the thrust condition and the rest condition. For such purpose, the thrust portion can be elastically deformable between the thrust condition and the rest condition.

However, the possibility of providing for a removable portion placed in closing the through access 18 of the release portion, which is configured for being preliminarily removed in order to allow the access to the safety device, cannot be excluded; in such configuration, the removable portion can act as device as proof of tampering, capable of showing an attempt to open the package.

As is visible for example in FIGS. 2 and 3, the release portion 17, optionally the through access 18, is defined in interposition between the two tabs of the first coupling portion 12: the two tabs 12*a* are positioned symmetrically with respect to the release portion 17. Still in the locking condition, the second coupling portion 13, optionally the panel of the second coupling portion 13 is interposed between the release portion 17 and the first coupling portion 12, as illustrated in FIGS. 6 and 6A. The release portion 17 (optionally the through access 18) allows the user—by means of a direct manual action or by means of the insertion of an opening device—to push the panel 13*a*, optionally the portions 13*a*' and 13*a*", of the second coupling portion 13 against the lateral wall 4 of the container carrying the said portion in a manner such to cause the disengagement with the at least one tab 12*a* of the first coupling portion 12 (condition schematized in FIG. 7).

The opening device may be part of the package 100. In addition, if at least one first and second coupling portion 12, 13 is disengageable by means of the opening device (interposition of said opening device between the first and the second coupling portion 12, 13), the package could also comprise at least one pocket 80 configured for engaging the opening device in a manner such that the latter can prevent, following the passage of container 1 and case 102, at least one first coupling portion 12 from being engaged with at least one respective second coupling portion 1; in such configuration, if the package 100 has only one pair of coupling portions (first and second coupling portion 12, 13) and the opening device is housed in the pocket 80, the safety device 11 might not define the locking condition since the opening device prevents the engagement between said first and second coupling portions 12, 13. Such configuration could be useful if it is not necessary for the user to lock the package with every closing thereof.

If instead the package 100 has a pair of coupling portions (first and second coupling portion 12, 13) disengageable by means of the opening device and at least one pair of coupling portions 12, 13 manually disengageable by the user (for example directly by means of a finger of the user), the user can insert the opening device (before the closed condition of the package) into the pocket 80 in a manner such to prevent the coupling portions 12, 13, configured for engaging by means of said opening device, from being engaged with each other once the closed condition of the package is defined; in such case, the package 100 would be openable following the disengagement of the first and second coupling portion 12, 13 manually disengageable by the user. Also in this case, the pocket 80 would allow facilitating the opening of the package (only manual) for a user if the package did not require a double closure (closure openable manually and by means of opening device). In the enclosed figures, a package 100 was illustrated in a non-limiting manner, having a case completely separable from the container. However the possibility of making a package having a case engaged with the container at a lateral wall or directly connected to the free edge 6 of the opening cannot be excluded.

Manufacturing Process

Also forming the object of the present invention is a process of making a package 100 in accordance with one or more of the enclosed claims and/or in accordance with the above-reported description.

The process provides for the arranging of the case 102 attainable by means of a first flat blank 50 made of sheet material, optionally paper. The first blank 50 comprises:

- a central sheet 51,
- a predetermined number of lateral sheets 52 integrally joined to the central sheet 51 and emerging from the latter starting from a perimeter edge,
- at least one peripheral sheet 53 engaged with at least one of said lateral sheets 52.

The central sheet 51 has a polygonal shape, optionally rectangular or square. From each side of the central sheet 51, a lateral sheet 52 is extended, also having a polygonal shape, optionally rectangular or square. The arranging of the case 102 comprises the sub-step of folding the predetermined number of lateral sheets 52 in order to define the predetermined number of lateral walls 104 of the case 102. In detail, the lateral sheets 52 are folded with respect to the central sheet 51 in a manner such that from the flat blank it is possible to obtain a case having three-dimensional conformation. The lateral sheets 52 are constrained to each other in a manner such that the case 102 can maintain its three-dimensional shape; the lateral sheets 52 can be directly constrained to each other by means of glue or any one adhesive material. Alternatively, the blank 50 can be provided with at least one connection sheet 55 which integrally joins two adjacent lateral sheets 52 (FIG. 2); in such configuration, the process—simultaneous with the folding of the lateral sheets 52—provides for the superimposition and the joining, for example by means of gluing, of the connection sheet 55 to adjacent folded lateral sheets: in this manner, the case can maintain its three-dimensional shape with the lateral sheets 52 which define the lateral walls 104 and the central sheet to define the top wall 109.

The process also provides for defining the at least one first coupling portion 12 by means of the at least one peripheral sheet 53. In detail, the peripheral sheet 53 is integrally joined with at least one lateral sheet 52 of the first blank 50; the peripheral sheet 53 of the first blank 50 emerges from a perimeter edge of at least one lateral sheet 52 of the first blank 50 itself on the side opposite the central sheet 51 of the first blank. In the enclosed figures, illustrated in a non-limiting manner, a first blank 50 comprises two opposite peripheral sheets 53. The possibility of providing for one or more peripheral sheets integrally joined and emerging from each lateral sheet 52 cannot be excluded.

The first coupling portion 12 is made by folding of the peripheral sheet 53 of the first blank 50 above the lateral sheet 52 of the same first blank 50 with which said peripheral sheet 53 is integrally joined. Following the folding of the peripheral sheet 53, at least one part of this is constrained, e.g. by means of gluing, to a part of the lateral sheet with which it is directly integrally joined (directly to the lateral wall 104). The folding of the at least one peripheral sheet 53 can be executed before, simultaneously with or after the folding and the constraining of the lateral sheets 52. In one embodiment, the peripheral sheets are folded before the folding of the lateral sheets; only following the folding of the peripheral sheets, the process provides for the folding and constraining of the lateral sheets in a manner such that simultaneously with the definition of the lateral walls 104 one obtains the definition of the first coupling portion 12. As is visible from FIG. 1A, each peripheral sheet 53 can comprise a first and a second portion 53*a*, 53*b* distanced, side-by-side each other and engaged with a same lateral sheet 52; the first and second portion 53*a*, 53*b* of said peripheral sheet 53 are configured for defining—following the folding of the peripheral sheet and of the lateral sheets 52—the side-by-side tabs 12*a* of the first coupling portion 12. The central sheet 51, the lateral sheets 52 and the peripheral sheets 53 of the first blank 50 can be integrally joined to define a single blank made in a single piece, e.g. at least partly made of paper material. The case 102 is therefore obtainable by means of steps of folding and gluing of a single blank sheet (first flat blank 50). The first blank 50 can be obtained by means of one or more steps of die cutting a single precursor sheet.

Figure 11:
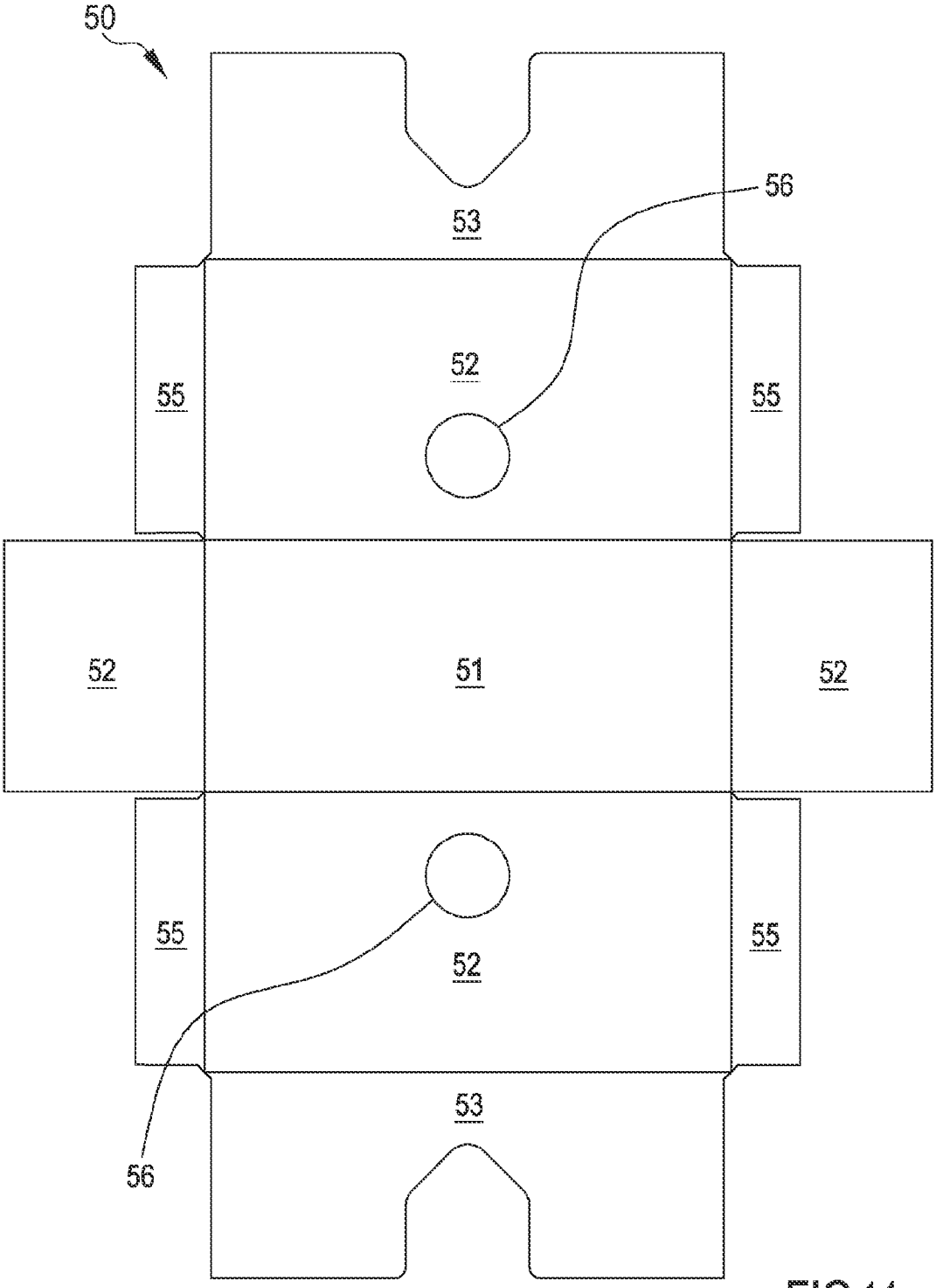
FIGS. 11 and 12 respectively illustrate further blanks for making a container and a case of a child-proof package in accordance with the present invention.

As described above, the case 102 also carries the release portion 17 which is obtainable by means of the arranging of a notch 56 of at least one lateral sheet 52 of the first blank 50: the notch 56 is of the passing through the lateral wall 52 and is executed on the lateral wall 52 carrying the peripheral sheet 53. In particular, the notch 56 is executed at the peripheral sheet 53 and in particular in interposition between the first and second portion 53*a*, 53*b* of each peripheral sheet 53. The notch 56 can be an open profile (FIG. 2) or a closed profile (FIG. 11) in a manner such that the same can define the through access 18; alternatively, the notch 56 can be an open section adapted to define the thrust portion, as described above.

The process provides for the arranging of the container 1 attainable by means of a second flat blank 70 made of sheet material, optionally paper. the first blank 70 comprises:

a central sheet 71, a predetermined number of lateral sheets 72 integrally joined to the central sheet 71 and emerging from the latter starting from a perimeter edge.

The central sheet 71 has a polygonal shape, optionally rectangular or square. From each side of the central sheet 71, a lateral sheet 72 is extended, also having a polygonal shape, optionally rectangular or square.

The arranging container 1 comprises the sub-step of folding the predetermined number of lateral sheets 72 in order to define the predetermined number of lateral walls 4 of the container 1. In detail, the lateral sheets 72 are folded with respect to the central sheet 71 in a manner such that from the flat blank 70, it is possible to obtain a container 1 having three-dimensional conformation. The lateral sheets 72 are constrained to each other in a manner such that the container 1 can maintain its three-dimensional shape; the lateral sheets 72 can be constrained directly to each other by means of glue or any one adhesive material. Alternatively, the blank 70 can be provided with at least one connection sheet 75 which integrally joins two adjacent lateral sheets 72 (FIG. 1); in such configuration, the process—simultaneously with the folding of the lateral sheets 72—provides for the superimposition and the joining, for example by means of gluing, of the connection sheet 75 to adjacent folded lateral sheets 72: in this manner, the container 1 can maintain its three-dimensional shape with the lateral sheets 72 which define the lateral walls 4 and the central sheet 71 to define the bottom wall 9.

The process also provides for defining the at least one second coupling portion 13. Each second coupling portion 13 can be executed by means of the arranging of a peripheral sheet 73 integrally joined with at least one of said lateral sheets 72 and emerging from a perimeter edge of at least one lateral sheet 72 of the second blank 70 itself on the side opposite the central sheet 71 of the second blank. Then, the peripheral sheet 73 is folded above the lateral sheet 72 of the same second blank 70 with which said peripheral sheet 73 is integrally joined; following the folding, the peripheral sheet 73 is at least partly superimposed and facing the lateral sheet 72 with which it is directly integrally joined. Following the folding of the peripheral sheet 73, at least one part of this is constrained, for example by means of gluing, to a part of the lateral sheet 72 with which it is directly integrally joined (directly to the lateral wall 4). The folding of the at least one peripheral sheet 73 can be executed before, simultaneously with or after the folding and constraining of the lateral sheets 72. In one embodiment, the peripheral sheets 73 are folded before the folding of the lateral sheets 72; only following the folding of the peripheral sheets 73, the process provides for the folding and constraining of the lateral sheets 72 in a manner such that simultaneously with the definition of the lateral walls 4 one obtains the definition of the second coupling portion 13 in accordance with that illustrated in FIG. 4B.

Figure 1B:
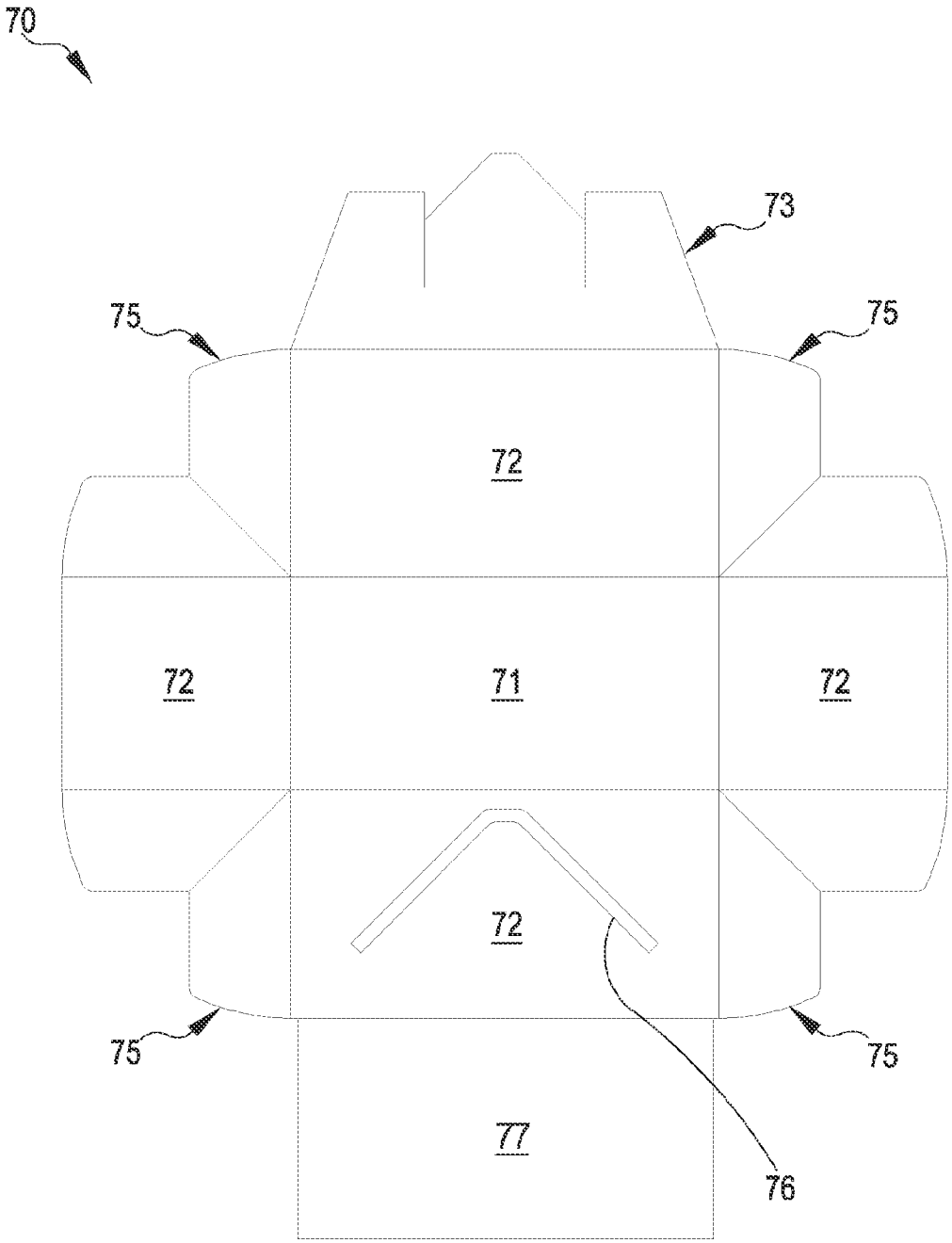
Figure 12:
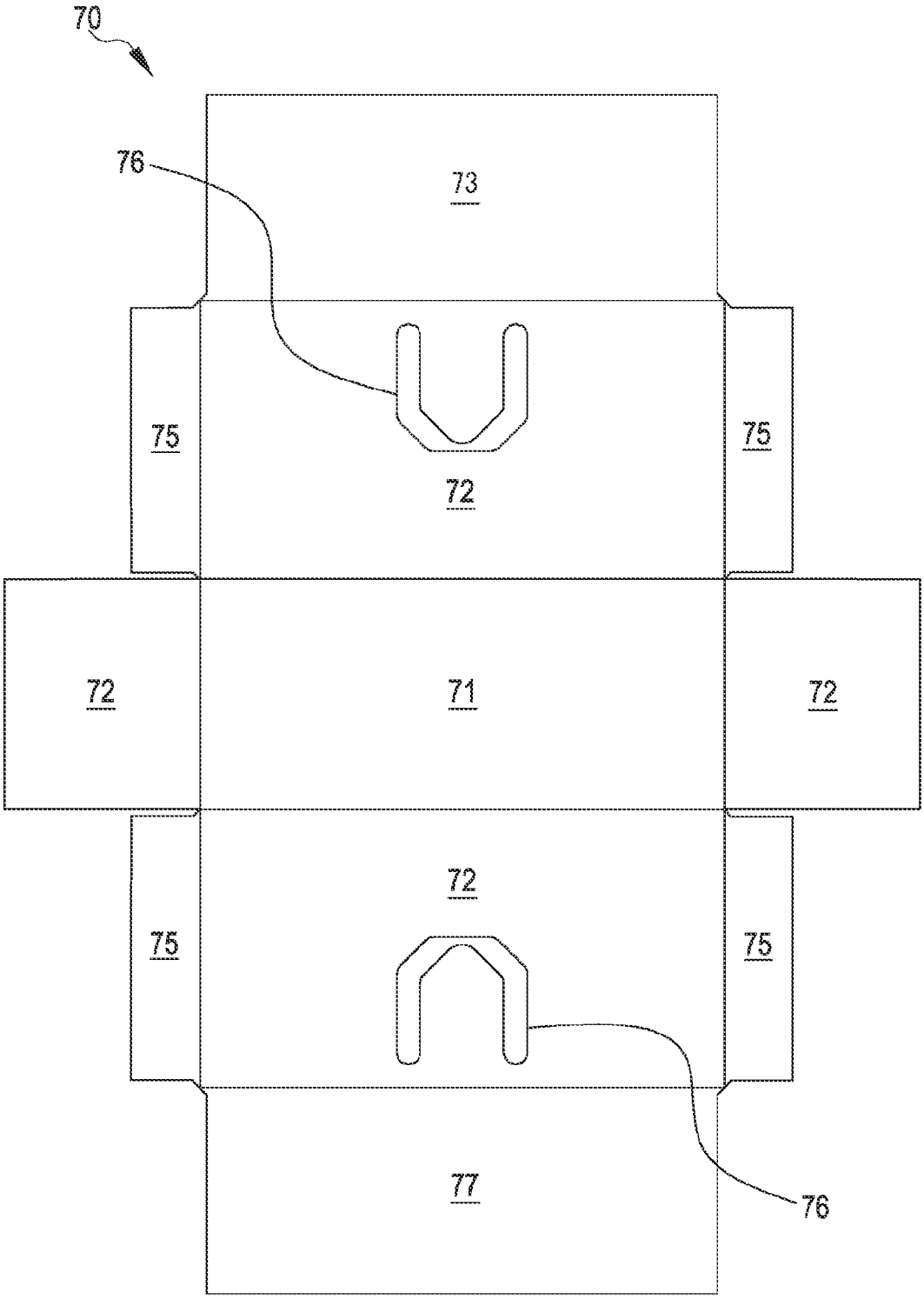
Figure 14:
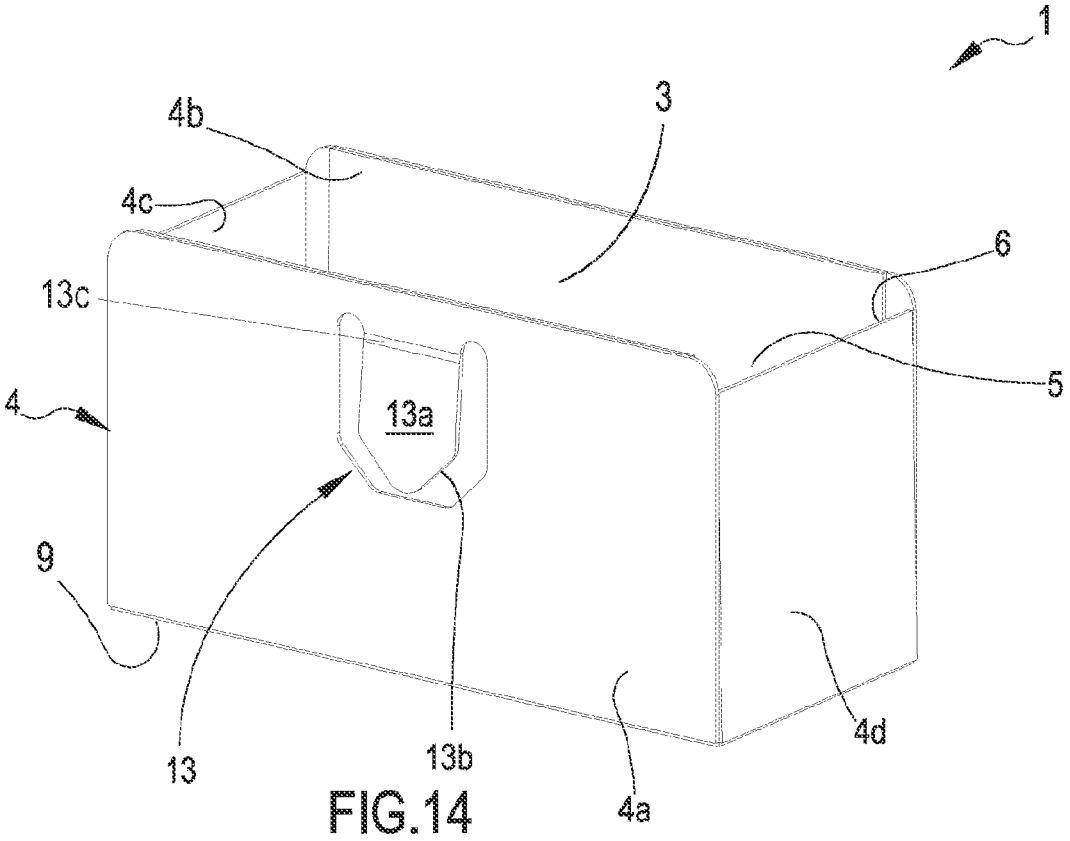
FIG. 14 is a further perspective view of a container of a package in accordance with the present invention.

Alternatively, the second coupling portion 13 can be obtained by means of a step of cutting one of said lateral sheets 72 of the second blank 70 in order to define, directly on said lateral sheet, at least one through notch 76 (FIG. 12) adapted to define the panel 13*a* of the second coupling portion 13 in accordance with that illustrated for example in FIG. 14. In FIG. 1B, a second blank 70 was illustrated having on one side a peripheral sheet 73 emerging from a lateral sheet 72, and on the opposite side a notch 76 adapted to define, on the lateral sheet 72, the panel 13*a* of the second coupling portion 13. The central sheet 71, the lateral sheets 72 and the possible peripheral sheet 73 (if present) of the second blank 70 can be integrally joined to define a single blank made in a single piece, for example at least partly made of paper material. The container 1 is therefore obtainable by means of steps of folding and gluing a single blank sheet (first flat blank 70). The second blank 70 can be obtained by means of one or more steps of die cutting a single precursor sheet. The first and second blanks 50, 70—even if obtainable by means of a step of die cutting a single sheet—are distinct and separate pieces that are separately workable in order to obtain a case 102 separated from the container 1.

Closing Method

Also forming the object of the present invention is a method for closing a package 100 in accordance with one or more of the enclosed claims and/or in accordance with the above-reported description.

The method comprises a first step of positioning the case 102 externally with respect to the container 1 in a manner such that the latter can be at least partly housed in the internal volume of the case 102. Before the step of positioning the case 102 outside the container 1—said case and container are completely separate and distinct with respect to each other.

Then, case 102 and container 1 are relatively moved with respect to each other so as to define the closed condition. The relative movement of case and container in the closed condition allows carrying the first coupling portion 12 to the second coupling portion 13 where the two portions can be engaged with each other. The relative movement provides for the relative translation of the case 102 externally with respect to the container 1 with the lateral walls 104 of the case 102 strictly facing the lateral walls 4 of the container 1. The relative movement provides for the relative translation of the case 102 with respect to the container 1 up to an end stop position in which the top wall 109 of the case 102 is abutted against the free edge 6 of the container 1 (FIG. 6); in the end stop position, the free edge 106 of the case 102 is arranged at the bottom wall 9 of the container 1. In the end stop position the free edge 6 of the container is abutted against the top wall 109 of the case 102 and prevents a further relative moving closer between the bottom wall 9 of the container 1 and the top wall of the case 102. In the end stop position, the first coupling portion 12 is situated facing the second coupling portion 13 of the container 1 and ready for engagingly receiving the latter.

In fact, once such portions (12, 13) correspond with each other (e.g. in the end stop position), the engagement is obtained of the first and second coupling portions 12, 13 of the safety device 11 to define the locking condition. With relative movement of the case with respect to the container, it is intended the movement of both parts, i.e. case and container, or the movement of only one of said parts (only the case 102 or only the container), maintaining stopped the other of the two parts (maintaining fixed the case 102 or the container) in a manner such that a relative motion between these (case and container) is defined.

Opening Method

Also forming the object of the present invention is a method for opening a package 100 in accordance with one or more of the enclosed claims and/or in accordance with the above-reported description.

Before executing the method for opening the package 100, the latter is situated in the locking condition of the safety device.

The opening method comprises a step of contacting, from outside of the package 100, at least one between the first and the second coupling portion 12, 13 through the release portion 17. The contact can be direct or it can occur indirectly, for example by means of the thrust portion of the case 102. For example, the step of contacting at least one between the first and the second coupling portion 12, 13 comprises at least one between the following sub-steps:

- inserting at least one opening device through the through access 18 of the release portion 17,
- contacting manually and directly at least one between the first and the second coupling portion 12, 13, for example by means of insertion of a finger of a user through the through access 18 of the release portion 17,
- deforming a thrust portion of the same case 102 in a manner such that such thrust portion can contact at least one between the first and the second coupling portion 12, 13.

Then, the opening method provides for a step of disengaging the first and the second coupling portions 12, 13. The disengagement step comprises the thrust of the second portion of the container 1 in moving closer to the compartment 3 (FIG. 7), optionally by means of a manual intervention of a user (directly on the second portion 13 or indirectly by means of the elastic deformation of the thrust portion) or by means of an opening device.

Following the disengagement of the first and second coupling portions 12, 13, the opening method provides for a step of relative moving-away movement of container 1 and case 102 (condition illustrated in FIGS. 8 and 10) up to reaching the open condition of the case 102. The relative movement can be obtained by moving both the container and the case or can be executed by maintaining stopped one between said container and case and moving only the other between said container and case.

The invention claimed is:

1. A child-proof package comprising:

a container made of a first sheet defining a compartment configured to house at least one product, said container having a predetermined number of lateral walls, the lateral walls of the container defining an opening delimited by a free edge of the lateral walls, the opening of the container configured to allow insertion of the at least one product and removal of the at least one product from the container, a case made of a second sheet having a predetermined number of lateral walls, the lateral walls of the case defining at least one access delimited by a free edge configured to allow the passage of the container, said predetermined number of lateral walls of the case delimiting an internal volume configured to receive in insertion at least part of the container, wherein the case and the container are relatively movable with respect to each other at least between:

a closed condition in which the case obstructs the opening of the container, wherein the container, in said closed condition, is at least partly arranged in the internal volume, and an open condition in which the case allows the communication between the compartment and the external environment, at least one safety device comprising:

at least one first coupling portion integral with the case and arranged in the internal volume, and at least one second coupling portion integral with the container and arranged outside the compartment, wherein the first coupling portion and the second coupling portion, in the closed condition, are configured to be in stable engagement with each other, externally with respect to the container, to define a locking condition of the safety device in which said first coupling portion and said second coupling portion prevent the case from passing from the closed condition to the open condition, wherein the safety device comprises a release portion configured to allow, at least in the locking condition of the safety device, intervention from outside the package on at least one from between the first coupling portion and the second coupling portion to allow the case to disengage from the container and to allow relative movement between the case and the container as the container transitions from the closed condition to the open condition, wherein the first coupling portion comprises a tab integral with a first lateral wall of the lateral walls of the case, wherein the first lateral wall of the case includes an inner wall portion, an outer wall portion and a first fold line between the inner wall portion and the outer wall portion, wherein the inner wall portion is adjacent the outer wall portion and the first fold line forms a portion of the free edge of the case, wherein the tab includes a tab free edge configured to form the stable engagement with the second coupling portion, wherein the tab is tilted relative to a lying plane of the inner wall portion of the first lateral wall by an angle in a range of 1° to 30°, wherein the tab of the first coupling portion extends from the outer wall portion of the first lateral wall of the case according to a direction entering said internal volume, wherein a second fold line in the inner wall portion defines an edge of the tab opposite to the tab free edge and the second fold line and tab are distanced from and separated from the first fold line and the free edge of the case along a line that is perpendicular the first fold line and intersects the first fold line and the second fold line, and wherein the tab free edge forms a portion of a perimeter of the inner wall portion of the first lateral wall.

2. The child-proof package according to claim 1, wherein the release portion is configured to define, on the first lateral wall of the case, at least one through access configured for allowing a user, at least in the locking condition, to intervene from outside the package on at least one of said first or second coupling portions, manually and/or by means of an opening device insertable through the through access.

3. The child-proof package according to claim 1, wherein the tab defines an undercut delimited by at least one gripping edge, entirely placed in the internal volume, wherein gripping edge is spaced from the free edge of the access, wherein at least one section of the gripping edge of the tab of said first coupling portion is tilted with respect to the free edge of the access by an angle comprised between 20° and 80°.

4. The child-proof package according to claim 3, wherein the tab is included in a pair of tabs, and portions of the gripping edges of the tabs in the pair of tabs form a concave profile whose concavity is directed on the opposite side with respect to the free edge of the case.

5. The child-proof package according to claim 3, wherein the tab is included in a pair of tabs each and portions of the gripping edges of the tabs in the pair of tabs in combination form a C-shaped or V-shaped form, having concavity directed on the opposite side with respect to the free edge of the case.

6. The child-proof package according to claim 1, wherein the second coupling portion comprises at least one panel engaged with at least one lateral wall of the container and emerging from said lateral wall according to a direction exiting from the compartment, wherein the panel of the second coupling portion defines an undercut delimited by at least one gripping edge placed outside the compartment, distinct and distanced from the free edge of the opening of the container, and wherein the undercut defined by the panel of the second coupling portion, in the closed condition of the package, is stably engaged with the tab of the first coupling portion to define said locking condition.

7. The child-proof package according to claim 6, wherein the entire at least one panel of the second coupling portion is distanced from the free edge of the opening of the container, wherein the at least one panel, is placed at a minimum distance of the free edge of the opening of the container equal to or greater than 5 mm.

8. The child-proof package according to claim 7, wherein the panel of the second coupling portion extends starting from an attachment portion and the second coupling extends along a longitudinal direction perpendicular to the free edge of the container, wherein the attachment portion of the panel is integrally joined with the lateral wall of the container directly carrying said panel, said attachment portion being distanced from the free edge of the container, and wherein the panel extends length-wise starting from said attachment portion along said longitudinal direction, wherein the length of said panel of the second coupling portion, measured along said longitudinal direction, is equal to or greater than 15 mm.

9. The child-proof package according to claim 8, wherein the ratio between the distance present between the panel and the free edge of the container and the length of said panel is equal to or smaller than 2, wherein the predetermined length of the panel is measured along said predetermined longitudinal direction.

10. Package according to claim 7, wherein the gripping edge of the panel of said second coupling portion is tilted with respect to the free edge of the opening by an angle in a range of 20° to 80°.

11. The child-proof package of claim 1, wherein the first sheet has outer edges at a perimeter of the first sheet, and the tab free edge is formed by at least one of the outer edges of the first sheet.

12. A child-proof package comprising:

a container made of sheet material defining a compartment configured to house a product, said container having a predetermined number of lateral walls, the lateral walls of the container defining an opening delimited by a free edge of the lateral walls of the container, the opening of the container configured to allow insertion of the product into the container and removal of the product from the container, a case made of sheet material having a predetermined number of lateral walls, the lateral walls of the case defining at least one access delimited by a free edge of the lateral walls of the case and configured allow the passage of the container, said lateral walls of the case delimiting an internal volume configured to receive at least part of the container, wherein a first lateral wall of the lateral walls of the case includes an inner wall portion, an outer wall portion and a first fold line between the inner wall portion and the outer wall portion, wherein the inner wall portion is adjacent the outer wall portion and the first fold line forms a portion of the free edge of the case, wherein the case and the container are relatively movable with respect to each other between:

a closed condition in which the case obstructs the opening of the container, wherein the container, in said closed condition, is at least partly in the internal volume, an open condition in which the case allows communication between the compartment and the external environment, at least one safety device comprising:

a first coupling portion including a tab integral with the inner wall portion of the first lateral wall of the case and arranged in the internal volume, and a second coupling portion carried by the container and arranged outside the compartment, wherein the first coupling portion and the second coupling portion, in the closed condition, are stably engaged with each other, externally with respect to the container, to define a locking condition of the safety device in which said first coupling portion and said second coupling portion prevent the case from passing from the closed condition to the open condition, wherein the tab of the safety device comprises a free tab edge configured to engage the container in the closed condition and to disengage from the container and allow the case to move relative to the container as the container transitions from the closed condition to the open condition, wherein the child-proof package further comprises a removable portion on at least a portion of a first lateral wall of the case and the removable portion covers a through access in the first lateral wall and is configured to be removed to allow access to the through access;

wherein the through access is configured to allow a user, while the safety device is at least in the locking condition, to intervene from the outside of the package through the through access on said second coupling portion manually or by using an opening device insertable through the through access to cause the disengagement of the container from the case, wherein a second fold line in the inner wall portion of the first lateral wall defines an edge of the tab opposite the free tab edge, and the second fold line and the tab are distanced from and separated from the first fold line and free edge of the case along a line that extends perpendicular to the second fold line and passes through the second fold line and the first fold line, and wherein the free tab edge forms a portion of a perimeter of the inner wall portion of the first lateral wall.

13. The child-proof package according to claim 12, wherein the first coupling portion extends along a plane tilted with respect to a lying plane of the first lateral wall directly carrying said first coupling portion by an angle in a range of 1° to 30°.

14. A child-proof package comprising:

a container made of sheet material defining a compartment configured to house a product, said container having a predetermined number of lateral walls, the lateral walls of the container defining an opening delimited by a free edge of the lateral walls of the container, the opening of the container configured to allow insertion of the product into the container and removal of the product from the container, a case made of sheet material having a predetermined number of lateral walls, the lateral walls of the case defining at least one access delimited by a free edge of the lateral walls of the case and configured allow the passage of the container, said lateral walls of the case delimiting an internal volume configured to receive at least part of the container, wherein the case and the container are relatively movable with respect to each other between:

a closed condition in which the case obstructs the opening of the container, wherein the container, in said closed condition, is at least partly in the internal volume, an open condition in which the case allows communication between the compartment and the external environment, at least one safety device comprising:

a first coupling portion carried by the case and arranged in the internal volume, and a second coupling portion carried by the container and arranged outside the compartment, wherein the first coupling portion and the second coupling portion, in the closed condition, are stably engaged with each other, externally with respect to the container, to define a locking condition of the safety device in which said first coupling portion and said second coupling portion prevent the case from passing from the closed condition to the open condition, wherein the safety device comprises a through access on a first lateral wall of the lateral walls and configured to allow, intervention from outside the package on at least one of said first coupling portion or said second coupling portion to allow disengagement of the case from the container and passage of the case relative to the container as the container transitions from the closed condition to the open condition, and wherein the package comprises a removable portion placed against the first lateral wall and configured to close the through access and the removable portion is configured to be removed to allow the access to the safety device, and wherein the first coupling portion defines a pair of tabs separated by a gap aligned with the second coupling portion in the closed condition, and the gap having a width parallel to the free edge of the case and the width increases as the gap extends away from the free edge of the case.

* * * * *